US009019319B2

(12) United States Patent
Wakatsuki et al.

(10) Patent No.: US 9,019,319 B2
(45) Date of Patent: Apr. 28, 2015

(54) DISPLAY DEVICE FOR VEHICLE

(75) Inventors: Tomotake Wakatsuki, Susono (JP); Koji Ishii, Susono (JP)

(73) Assignee: Yazaki Corporation, Tokyo (JP)

( * ) Notice: Subject to any disclaimer, the term of this patent is extended or adjusted under 35 U.S.C. 154(b) by 431 days.

(21) Appl. No.: 12/938,423

(22) Filed: Nov. 3, 2010

(65) Prior Publication Data

US 2011/0128311 A1 Jun. 2, 2011

(30) Foreign Application Priority Data

Nov. 27, 2009 (JP) ..... 2009-269553
Nov. 27, 2009 (JP) ..... 2009-269554
Nov. 27, 2009 (JP) ..... 2009-269555

(51) Int. Cl.
*G09G 5/10* (2006.01)
*G09G 3/22* (2006.01)

(52) U.S. Cl.
CPC ..... *G09G 3/22* (2013.01); *G09G 2320/0233* (2013.01); *G09G 2320/041* (2013.01); *G09G 2320/048* (2013.01); *G09G 2340/10* (2013.01); *G09G 2360/16* (2013.01); *G09G 2380/10* (2013.01)

(58) Field of Classification Search
USPC ..... 345/82
See application file for complete search history.

(56) References Cited

U.S. PATENT DOCUMENTS 7,053,874 B2 5/2006 Koyama
2002/0033783 A1 3/2002 Koyama et al.
2003/0214467 A1 11/2003 Koyama et al.
2005/0110803 A1 5/2005 Sugimura
2005/0253877 A1* 11/2005 Thompson ..... 345/698
2006/0077136 A1 4/2006 Cok
2006/0262048 A1 11/2006 Yamada
2007/0164932 A1* 7/2007 Moon ..... 345/63
2007/0171142 A1 7/2007 Ikarashi et al.

(Continued)

FOREIGN PATENT DOCUMENTS

EP 1521458 A1 4/2005
EP 1808843 A1 7/2007

(Continued)

OTHER PUBLICATIONS

Extended European Search Report issued on Mar. 12, 2012 by the European Patent Office in the corresponding European Patent Application No. 10189593.6.

(Continued)

*Primary Examiner* — Robin Mishler
(74) *Attorney, Agent, or Firm* — Sughrue Mion, PLLC

(57) ABSTRACT

A display device for a vehicle includes: a self-luminous indicator which has a display screen with a plurality of pixels; a display control unit that displays image information indicating at least a given display pattern on a display screen of the self-luminous indicator; a display time measuring unit that measures a display time of the self-luminous indicator; and a brightness adjusting unit that adjusts the brightness of the display screen on the basis of at least the display time measured by the display time measuring unit in order to suppress non-uniform brightness deterioration of the display screen when the non-uniform brightness deterioration occurs on the display screen. The display control unit displays the image information on the display screen of the self-luminous indicator with the brightness adjusted by the brightness adjusting unit.

8 Claims, 17 Drawing Sheets

(56) References Cited

U.S. PATENT DOCUMENTS

| | | | | |
|---|---|---|---|---|
| 2009/0237390 | A1 | 9/2009 | Koyama et al. | |
| 2010/0323762 | A1* | 12/2010 | Sindhu | 455/566 |

FOREIGN PATENT DOCUMENTS

| | | | |
|---|---|---|---|
| JP | 2001175221 | A | 6/2001 |
| JP | 2002-175041 | A | 6/2002 |
| JP | 2002-372949 | A | 12/2002 |
| JP | 2003202838 | A | 7/2003 |
| JP | 2003-228329 | A | 8/2003 |
| JP | 2005239042 | A | 9/2005 |
| JP | 2006343452 | A | 12/2006 |
| JP | 2008-139390 | A | 6/2008 |
| JP | 2009175443 | A | 8/2009 |
| JP | 2009-251111 | A | 10/2009 |
| WO | 2008152831 | A1 | 12/2008 |

OTHER PUBLICATIONS

Japanese Office Action; JP2009-269553; Feb. 28, 2013.
Office Action dated Jun. 4, 2013 issued by the Japanese Patent Office in counterpart Japanese Patent Application No. 2009-269553.
Office Action issued Apr. 9, 2013 by the Japanese Patent Office in corresponding Japanese Patent Application No. 2009-269554.
Office Action issued Apr. 16, 2013 by the Japanese Patent Office in counterpart Japanese Patent Application No. 2009-269555.
Office Action dated Aug. 6, 2013 issued by the Japanese Patent Office in counterpart Japanese Patent Application No. 2009-269554.
Communication dated Dec. 17, 2013, issued by the Japanese Patent Office in corresponding Application No. 2009-269554.
Office Action issued May 27, 2014 issued by the Japanese Patent Office in corresponding Japanese Application No. 2009-269554.

* cited by examiner

DISPLAY DEVICE FOR VEHICLE

BACKGROUND OF THE INVENTION

1. Technical Field

The present invention relates to a display device for a vehicle including a self-luminous indicator with a display screen and a display control unit that displays the image information, which has a first display portion for fixedly displaying a given display pattern and a second display portion that is formed in a different region from the first display portion and has a lower brightness than the first display portion, on the display screen of the self-luminous indicator.

In addition, the present invention relates to a display device for a vehicle which displays a display pattern on a self-luminous indicator with a gradation defined by the image information.

2. Background Art

Generally, a display device for a vehicle provided in the vehicle interior of the vehicle is disposed in an instrument panel ahead of the driver's seat so that the driver sitting in the driver's seat can view the display of each instrumental device with a steering wheel interposed therebetween. The display device for a vehicle is configured to have a plurality of display areas showing the traveling speed of a vehicle, the number of revolutions per unit time of an engine, the remaining quantity of fuel in a fuel tank, the temperature of coolant for an engine, and the like. These display areas are efficiently arrayed in the same casing so that the driver can understand a vehicle state at a glance.

The display device for a vehicle may include a self-luminous indicator, such as an organic EL (Electro Luminescence) device, an inorganic EL device, a vacuum fluorescent display (VFD), and a field emission display (FED), so that display patterns, such as a speedometer and a tachometer, are displayed by the self-luminous indicator. Moreover, regarding such a self-luminous indicator, as disclosed in JP-A-2003-228329, it is known that the emission characteristic of a light emitting device deteriorates with an emission time and the brightness obtained by the same input current is decreased accordingly. Therefore, when the emission brightness of a specific pixel is high, for example, when an icon is always displayed at the fixed position of a screen, it is known that a problem of "burn-in" occurs that the emission characteristic of the pixel noticeably deteriorates compared with other pixels.

A matrix driving type display disclosed in JP-A-2003-228329 is based on a technical background in which the input data to each pixel is integrated for every pixel at fixed periods in a state where a display panel is being driven, the correction data for equalizing the integrated values for all pixels is created in the subsequent unused state, and each pixel is made to emit light on the basis of the correction data.

In the display disclosed in JP-A-2003-228329, however, it is necessary to monitor each pixel on the basis of the input data. In this case, since a circuit, which monitors an input signal to a light emitting device and stores the cumulative amount, and the like are required, hardware measures are necessary. For this reason, since a correction method, a circuit configuration, and the like should be also changed if a light emitting device used is changed, it is not suitable for general purpose.

Moreover, when adjusting the brightness of an image by software, there has been a problem that the data volume increases because a plurality of images for adjustment are used. When adjusting one image by software, there has been a problem that smooth drawing becomes difficult since the adjustment processing takes time or a problem that an expensive graphics controller needs to be used, for example. Therefore, taking mounting it in a vehicle into consideration, it has been difficult to realize it in terms of the costs and the like.

Particularly when the image information for fixed display has a plurality of kinds of display colors (gradations), it is necessary to monitor each item of the input data. As a result, there has been a problem that a correction method or the hardware configuration becomes complicated.

Moreover, when a display device for a vehicle is mounted in a vehicle, a warranty of ten years (3500 hours) is demanded. However, if an indicator is displayed with high brightness, there has been a problem that it is difficult to keep the brightness of the indicator constant during the warranty period and the display screen becomes dark as years go by. For this reason, when deterioration of the brightness of an indicator is noticeable, the indicator or the display device for a vehicle itself has to be exchanged.

SUMMARY OF THE INVENTION

In view of the problems described above, it is an object of the invention to provide a display device for a vehicle which reduces non-uniformity of emission caused by burn-in without complicating the device configuration.

In addition, it is another object of the invention to provide a display device for a vehicle capable of reducing non-uniformity of emission caused by burn-in even if the image information formed by a plurality of kinds of display colors is fixed and displayed.

In addition, it is still another object of the invention to provide a display device for a vehicle capable of continuing the display with a fixed brightness without complicating the device configuration.

A display device for a vehicle, comprises; a self-luminous indicator which has a display screen with a plurality of pixels; a display control unit that displays image information indicating at least a given display pattern, on the display screen of the self-luminous indicator; a display time measuring unit that is adapted to measure a display time of the self-luminous indicator; and a brightness adjusting unit that is adapted to adjust the brightness of the display screen on the basis of at least the display time measured by the display time measuring unit in order to suppress non-uniform brightness deterioration in the display screen when the non-uniform brightness deterioration occurs on the display screen. The display control unit displays the image information on the display screen of the self-luminous indicator with the brightness adjusted by the brightness adjusting unit.

The display device may be configured as follows; the image information contains a first display portion for fixedly displaying the given display pattern, and a second display portion, which is formed in a different region from the first display portion and has a lower brightness than the first display portion; the brightness adjusting unit includes an adjustment gradation specifying unit that is adapted to specify an adjustment gradation of the second display portion, by which the first and second display portions have the same brightness, on the basis of the display time measured by the display time measuring unit when non-uniform brightness deterioration occurs on the display screen on which the first and second display portions are displayed; and the display control unit displays a display region of the display screen corresponding to the second display portion on the self-luminous indicator with the adjustment gradation specified by the gradation specifying unit.

The display device may be configured as follows: the image information indicates a display pattern formed by a plurality of kinds of display colors; and the brightness adjusting unit includes: a deterioration amount estimating unit that is adapted to estimate an amount of deterioration of the plurality of pixels forming the display screen, on the basis of the display time measured by the display time measuring unit and the display pattern indicated by the image information displayed on the display screen by the display control unit; and a correction unit that is adapted to correct the brightness of each of the plurality of pixels on the basis of the amount of deterioration estimated by the deterioration amount estimating unit so that the plurality of pixels have the same brightness.

The display device may be configured as follows: the display device comprises an image information storage unit for storing, as the image information, image information for setting the gradation of each of the plurality of pixels corresponding to the display pattern; the brightness adjusting unit includes a brightness deterioration amount estimating unit that is adapted to estimate an amount of brightness deterioration of each of the plurality of pixels on the basis of the display time measured by the display time measurement unit; and the display control unit includes; a first display control unit that displays the image information on the display screen with a brightness corresponding to an initial gradation which is lower than a gradation set by the image information; and a second display control unit that displays the image information on the display screen with a correction gradation, which is obtained by correction from the initial gradation to the high gradation set by the image information, according to the amount of brightness deterioration estimated by the brightness deterioration amount estimating unit.

According to the above configuration, it is possible to reduce non-uniformity of brightness deterioration in the display screen.

BRIEF DESCRIPTION OF THE DRAWINGS

In the accompanying drawings;

FIG. 15A shows the case where the display color is black, FIG. 15B shows the case where the display color is gray, and FIG. 15C shows the case where the display color is white;

EXEMPLARY EMBODIMENTS OF THE INVENTION

A display device for a vehicle according to an aspect of the present invention is configured by comprising: a self-luminous indicator which has a display screen with a plurality of pixels; a display control unit that displays image information indicating at least a given display pattern, on the display screen of the self-luminous indicator; a display time measuring unit that is adapted to measure a display time of the self-luminous indicator; and a brightness adjusting unit that is adapted to adjust the brightness of the display screen on the basis of at least the display time measured by the display time measuring unit in order to suppress non-uniform brightness deterioration in the display screen when the non-uniform brightness deterioration occurs on the display screen, wherein the display control unit displays the image information on the display screen of the self-luminous indicator with the brightness adjusted by the brightness adjusting unit.

In first to third embodiments described below, image information which is an object of brightness adjustment, details of a brightness adjusting section (or a method of brightness adjustment), and the like are different.

First Embodiment

Hereinafter, a display device for a vehicle according to a first embodiment of the invention will be described with reference to FIGS. 1 to 10.

Figure 1:
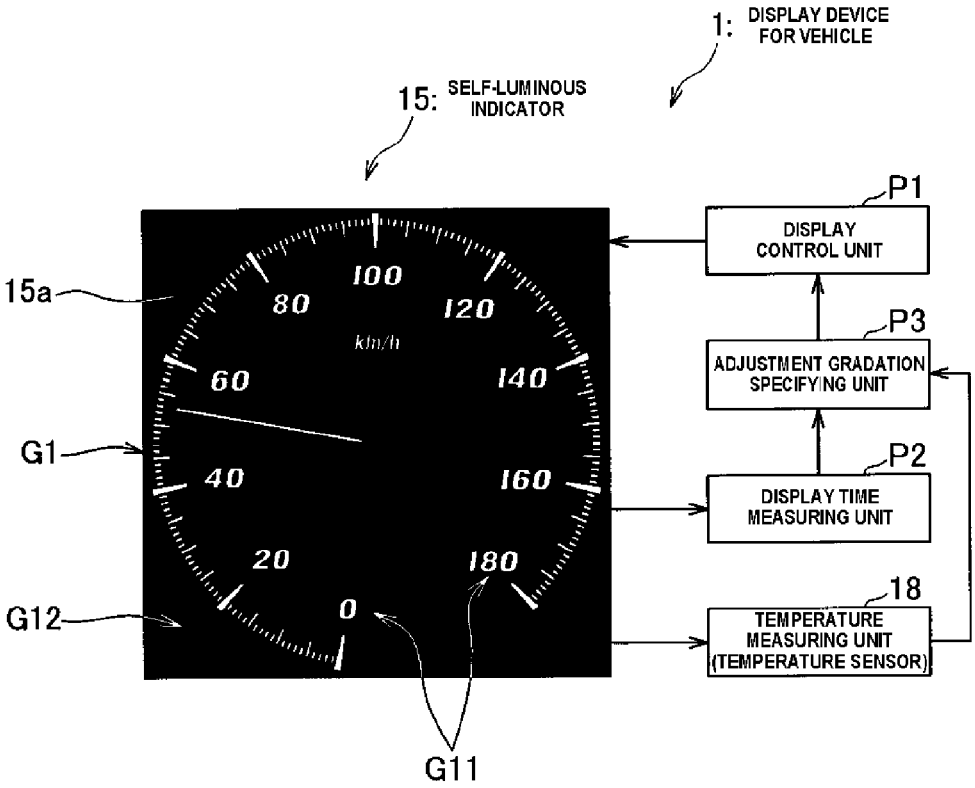
FIG. 1 is a block diagram showing the basic configuration of a display device for a vehicle according to a first embodiment of the invention.

As shown in FIG. 1 which shows the basic configuration, a display device 1 for a vehicle according to the first embodiment of the invention includes: a self-luminous indicator 15 that has a display screen 15*a*; a display control unit P1 that displays image information G1, which has a first display portion G11 fixedly displaying a given display pattern and a second display portion G12 that is formed in a different region from the first display portion G11 and has lower brightness than the first display portion G11, on the display screen 15*a* of the self-luminous indicator 15; a display time measuring unit P2 that measures a display time of the self-luminous indicator 15; and an adjustment gradation specifying unit P3 that specifies the adjustment gradation of the second display portion G12, by which the first and second display portions G11 and G12 have the same brightness, on the basis of the display time measured by the display time measuring unit P2 when non-uniform brightness deterioration occurs on the display screen 15*a* on which the first and second display portions G11 and G12 are displayed. The display control unit P1 displays a display region of the display screen 15*a* corresponding to the second display portion G12 on the self-luminous indicator 15 with the adjustment gradation specified by the gradation specifying unit P3.

According to the display device 1 for a vehicle, when non-uniform brightness deterioration occurs on the display screen 15*a*, on which the first and second display portions G11 and G12 are displayed, due to temporal change or the like, the adjustment gradation of the second display portion G12 by which the first and second display portions G11 and G12 have the same brightness is specified by the adjustment gradation specifying unit P3 on the basis of the display time of the self-luminous indicator 15 measured by the display time measuring unit P2. In addition, the display region of the display screen 15*a* corresponding to the second display portion G12 is displayed on the self-luminous indicator 15 by the display control unit P1 so as to have the adjustment gradation.

Since the brightness in the display region of the first display portion for fixed display with high brightness deteriorates with the display time of the self-luminous indicator and brightness deterioration in the display region of the second display portion occurs late, non-uniform brightness deterioration occurs on the display screen. However, since an adjustment gradation by which the first and second display portions have the same brightness is specified on the basis of the display time and the self-luminous indicator is displayed such that the display region of the display screen corresponding to the second display portion has the adjustment gradation, the entire display screen can be displayed with the same brightness even if non-uniform brightness deterioration (brightness spot) occurs between display regions corresponding to the first and second display portions due to temporal change or the like in the display screen of the self-luminous indicator. Therefore, since it is not necessary to monitor each pixel of the self-luminous indicator, non-uniformity of the brightness caused by burn-in can be reduced without complicating the device configuration. Moreover, since the device configuration is not complicated, an increase in device costs can be prevented. As a result, it can also contribute to low-priced vehicles and the like.

The display control unit P1 may be configured to translucently combine the image information G1 with transmissive image information in which a portion corresponding to the second display portion G12 has a certain transparency so as to have the adjustment brightness and displays the combined image on the self-luminous indicator 15.

According to the display device 1 for a vehicle, when the transmissive image information and the image information G1 are translucently combined by the display control unit P1, the combined image information in which a portion corresponding to the second display portion G12 has the adjustment brightness is displayed on the self-luminous indicator 15.

Since the image information obtained by translucently combining the transmissive image information and the image information is displayed on the self-luminous indicator, the portion corresponding to the second display portion can be made to have the adjustment brightness by translucent combining of the image information. For example, brightness adjustment can be performed by using a function of a graphics controller. Accordingly, it is possible to prevent the device from becoming complicated, and the cost can be reduced by using the existing functions effectively.

The display control unit P1 may be configured to, when switching the display content of the self-luminous indicator 15 to second image information G2 which is different from the image information G1, translucently combine the second image information G2 with the transmissive image information and displays the combined image on the self-luminous indicator 15.

According to the display device 1 for a vehicle, when changing the display content of the self-luminous indicator 15 from the image information G1 to the second image information G2, the second image information G2 and the transmissive image information are translucently combined by the display control unit P1 and the combined image is displayed on the self-luminous indicator 15.

When changing the display content of the self-luminous indicator from the image information to the second image information, the second image information and the transmissive image information corresponding to the image information are translucently combined and the combined image is displayed on the self-luminous indicator. Accordingly, even if a brightness spot is generated between the regions corresponding to the first and second display portions on the display screen of the self-luminous indicator, the region where deterioration occurs late can be made to have the adjustment brightness on the basis of the transmissive image information. As a result, non-uniform emission caused by burn-in of the display screen can be made to be unnoticeable even if the display content of the self-luminous indicator is changed to the second image information.

The display device 1 may be configured by comprising a temperature measuring unit (a temperature sensor) 18 that measures the temperature of the self-luminous indicator 15, wherein the adjustment gradation specifying unit P3 corrects the display time from the relationship between the temperature measured by the temperature measuring unit 18 and the life of the self-luminous indicator 15 and specifies the adjustment gradation of the second display portion G12, by which the first and second display portions G11, G12 have the same brightness, on the basis of the corrected display time.

According to the display device 1 for a vehicle, when the temperature of the self-luminous indicator 15 is measured by the temperature measuring unit 18, the actually measured display time is corrected from the relationship between the measured temperature and the life of the self-luminous indicator 15. Regarding the relationship between the temperature and the life of the self-luminous indicator 15, it becomes clear that the life when the self-luminous indicator 15 is used in a low-temperature condition is longer than that in a high-temperature condition. For this reason, the display time is corrected so as to absorb the difference of life caused by the temperature. On the basis of the corrected display time, the adjustment gradation of the second display portion G12 by which the first and second display portions G11 and G12 have the same brightness is specified by the adjustment gradation specifying unit P3.

Since the display time of the self-luminous indicator is corrected to a display time suitable for the temperature, the adjustment gradation by which the first and second display portions have the same brightness is specified on the basis of the corrected display time, and the self-luminous indicator is displayed so that the display region of the display screen corresponding to the second display portion has the adjustment gradation, the entire display screen can be displayed with the same brightness without being influenced by usage environment of the self-luminous indicator and the like even if non-uniform brightness deterioration (brightness spot) occurs between the display regions corresponding to the first and second display portions due to temporal change or the like in the display screen of the self-luminous indicator.

Figure 2:
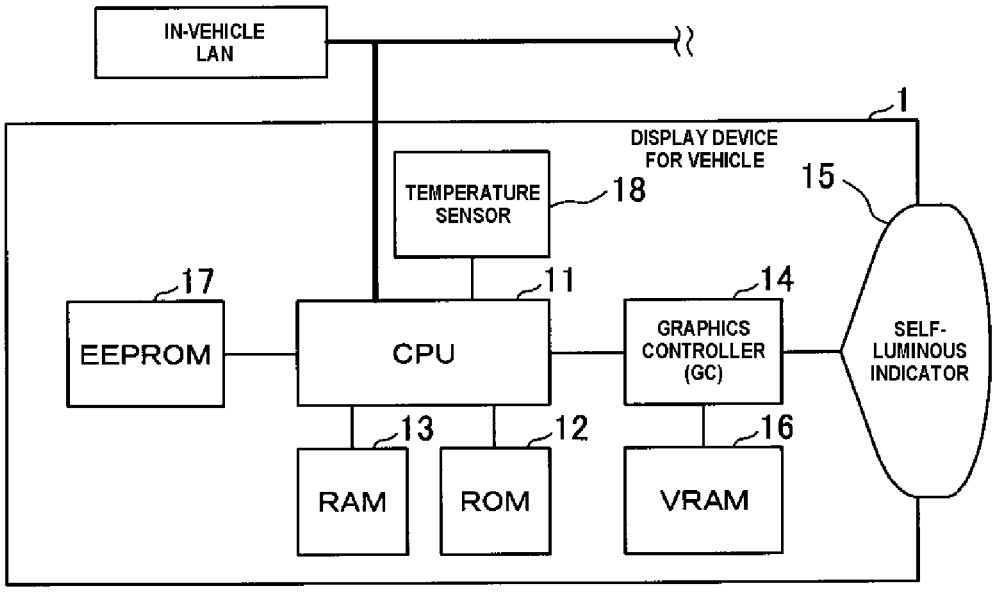
FIG. 2 is a block diagram showing the schematic configuration of the display device for a vehicle according to the first embodiment of the invention.

In FIG. 2, the display device 1 for a vehicle is built in a vehicle as a graphic meter, for example. The display device 1 for a vehicle includes: a central processing unit (CPU) 11 which performs various kinds of processing, control, and the like according to a program set in advance; a ROM 12 which is a read only memory that stores a program for the CPU 11 and the like; a RAM 13 which is a readable and writable memory that stores various kinds of data and has an area required for processing work of the CPU 11; a graphics controller (GC) 14; the self-luminous indicator (also called an indicator) 15; a VRAM (Video Random Access Memory) 16; an EEPROM (Electrically Erasable Programmable Read-Only Memory) 17; and a temperature sensor 18.

The CPU 11 is electrically connected with the ROM 12, the RAM 13, the GC 14, and the temperature sensor 18. In addition, the CPU 11 is communicably connected with an in-vehicle LAN of a vehicle, in which the display device 1 for a vehicle is mounted, through a communication device (not shown). In addition, the indicator 15 and the VRAM 16 are connected to the GC 14 in order to display various kinds of data.

The ROM 12 stores a program for controlling the entire processing in the display device 1 for a vehicle and the like. The CPU 11 controls display of the indicator 15 by outputting a display request of a given display image to the GC 14 by executing a program. That is, the ROM 12 stores various programs for making the CPU 11 function as various units, such as the display time measuring unit P2 and the adjustment gradation specifying unit P3 shown in FIG. 1.

Figure 3:
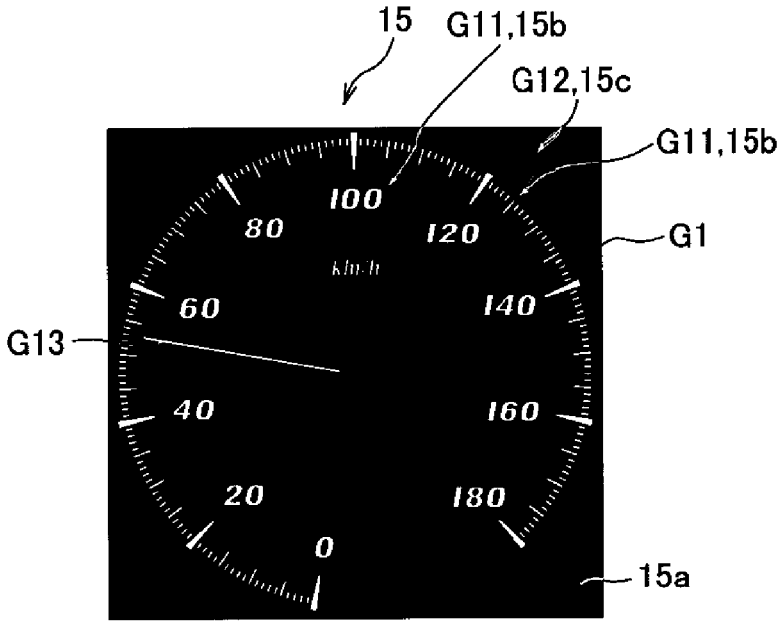
FIG. 3 shows a display example of the image information in the first embodiment of the invention.
Figure 4:
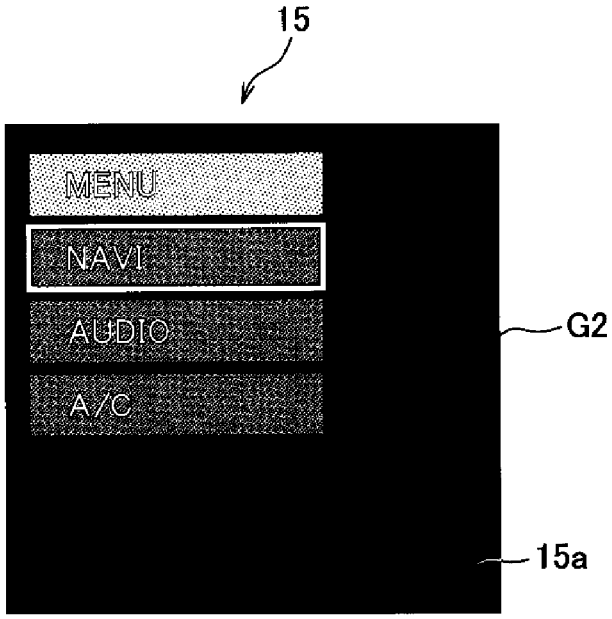
FIG. 4 shows a display example of the second image information in the first embodiment of the invention.

In response to the display request from the CPU 11, the GC 14 performs switching display of the first image information G1 and the second image information G2 on the indicator 15 by drawing each of the first image information G1 shown in FIG. 3 and the second image information G2 shown in FIG. 4 on the basis of various kinds of information (data) of the VRAM 16. Moreover, although the case where the GC 14 functions as the display control unit P1 shown in FIG. 1 is described in the present embodiment, various embodiments, such as making the CPU 11 function as the display control unit P1, may also be considered.

The indicator 15 has the display screen 15*a* on which various kinds of image information shown in FIGS. 3 and 4 are displayed, and the display screen 15*a* is provided on an instrument panel of the vehicle so that the driver can view it. In addition, the indicator 15 functions as a known meter by normally displaying the first image information G1 shown in FIG. 3 on the display screen 15*a*. The indicator 15 can draw a character, a figure, and the like on the display screen 15*a* by turning on/off display units (pixels) arrayed in a matrix. That is, the indicator 15 has a configuration capable of performing dot matrix display. For example, a display device, such as an organic EL (Electro Luminescence) device, may be arbitrarily used. In addition, the indicator 15 is configured to perform switching display of the first image information G1, the second image information G2, and the like on the display screen 15*a* by turning on/off each pixel by control of the GC 14.

As is well known, the VRAM 16 shown in FIG. 2 is a memory which stores the content displayed on the indicator 15, and stores various kinds of information involving the first image information G1 and the second image information G2 or the transmissive image information.

As shown in FIG. 3, the first image information G1 includes: the first display portion G11 which performs fixed display of a given display pattern; the second display portion G12 which is formed in a different region from the first display portion G11 and has lower brightness than the first display portion G11; and an indicating portion G13 which is displayed to rotate up to the indicating position of an index corresponding to the measured amount. In the present embodiment, the case will be described in which a design pattern of a speedometer is used as the given display pattern. However, the invention is not limited to this, and it is arbitrarily defined by the display form of embodiments, such as a tachometer and a fuel gauge.

The first display portion G11 is a region where a plurality of scale marks and indices, such as a figure and a unit, are fixed and displayed with given brightness. The second display portion G12 is a background of the display pattern. For example, the second display portion G12 is based on a dark color system such as black, dark gray, and dark blue, with lower brightness than the indices. The second display portion G12 may also be displayed with a plurality of display colors. For example, a region of the background equivalent to the danger range of an index may be displayed with a warning color. The indicating portion G13 is equivalent to an indicator, such as a known speedometer. The indicating portion G13 is displayed in the shape of a straight line from the center of the first image information G1 toward the first display portion G11 while being updated according to a change in the measured amount or the like in the rotation range set in advance.

When the first image information G1 is displayed on the display screen 15*a* of the indicator 15, a portion where the first display portion G11 is displayed is a first display region 15*b* and a portion where the second display portion G12 is displayed is a second display region 15*c*. Moreover, the indicator 15 controls display of each corresponding pixel element of the first and second display regions 15*b* and 15*c*.

The second image information G2 is an image switched from the first display portion G1, which is normally displayed on the indicator 15, in response to a switching request from a user or at a predetermined switching timing. That is, the second screen information G2 is displayed in the same region as the first screen information G1 on the display screen 15*a* of the indicator 15. In addition, the second image information G2 is image information showing a menu screen for selecting "NAVI (navigation)", "AUDIO", and "A/C (air conditioner)", as shown in FIG. 4.

The transmissive image information shows a region (display pattern) of the display screen 15*a* where brightness deterioration by temporal change or the like occurs late, and is a mask image which is transmitted through a portion corresponding to the second display portion G12 so as to have the adjustment brightness. The transmissive image information is information capable of specifying an image which defines a portion through which the information is to be transmitted, that is, a background portion of the first display portion G11 corresponding to a display pattern, such as a speedometer, and is used for an alpha blending (α blending) function of the GC 14.

As is well known, alpha blending is a function of translucently combining two images using a coefficient (α value). Moreover, the α value means the transmittance information which is set for each pixel (point) in the digital image data processed by a computer, and complete transparence (colorless) to incomplete translucence (cannot be transmitted through a background color at all) can be set. In addition, when a computer processes an image, the trichromatic information of R (red), G (green), and B (blue) regarding each pixel is given as color information, and a color is expressed by the combination (four colors in the case of CMYK mode). When expressing the transparency of a pixel, one pixel is displayed by combining four items of the information in addition to the α value.

In the present embodiment, therefore, the case will be described in which the α value is calculated on the basis of brightness deterioration and the transmittance of the display region with respect to each pixel is specified on the basis of the α value in a configuration capable of specifying the second display region (background portion) 15*c* of the display screen 15*a* corresponding to the second display portion G12 using the transmissive image information. When the α value is input from the CPU 11, the GC 14 creates or extracts the transmissive image information, in which a portion equivalent to the second display portion G12 is the α value, and stores it in the VRAM 16. Then, the GC 14 displays the transmissive image information and the first image information G1 of the VRAM 16 on the indicator 15 after alpha blending. As a result, the indicator 15 displays the first image information G1 in which the brightness of the entire screen of the first and second display portions G11 and G12 has been uniformly adjusted. In addition, when the GC 14 receives a switching request from the CPU 11, the GC 14 displays the second image information G2 of the VRAM 16 and the transmissive image information on the indicator 15 after alpha blending.

The temperature sensor 18 has a sensor element provided in the display device 1 for a vehicle. The sensor element outputs a temperature signal corresponding to the temperature of the installation place to the CPU 11. In addition, the CPU 11 is configured to detect the temperature of the display device 1 for a vehicle on the basis of the temperature signal from the temperature sensor 18 and to use the temperature for determination (prediction) regarding deterioration of the indicator 15 or the like. Alternatively, the temperature sensor 18 may be removed from the configuration of the display device 1 for a vehicle when the temperature is not used for determination of brightness deterioration.

Next, an example of a method of deriving the relationship between a display time of the indicator 15 and the α value will be described with reference to FIGS. 5 to 8. In addition, it will be described on the assumption that the gamma characteristic is set to 1.0.

Figure 5:
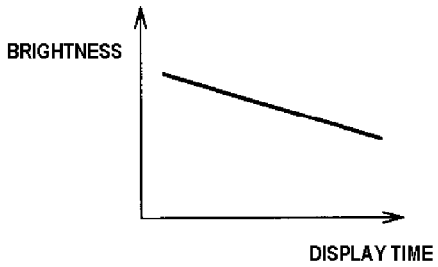
FIG. 5 is a graph showing the relationship between the brightness and a display time in a self-luminous indicator.

First, as shown in FIG. 5, the relationship between a display time and a decrease (deterioration) in brightness of the indicator 15 used in the display device 1 for a vehicle is derived from results of measurement, simulation, and the like. Thus, the brightness deterioration characteristic unique to the indicator 15 is derived. In FIG. 5, the vertical axis indicates a brightness and the horizontal axis indicates a display time.

Figure 6:
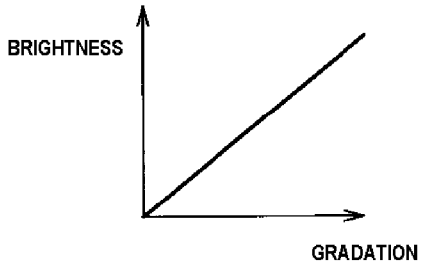
FIG. 6 is a graph showing the relationship between the brightness and the gradation in a self-luminous indicator.
Figure 7:
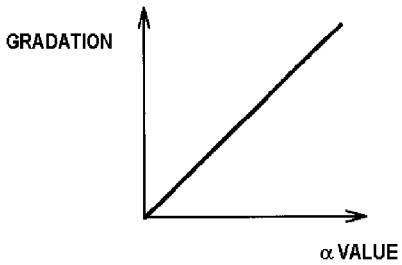
FIG. 7 is a graph showing the relationship between the brightness and the $\alpha$ value in a self-luminous indicator.

Using a pixel which has not deteriorated as a reference on the display screen 15*a* of the indicator 15, the relationship between the brightness and the gradation shown in FIG. 6 and the relationship between the gradation and the α value shown in FIG. 7 are derived from results of measurement, simulation, and the like. In FIGS. 6 and 7, upper limits of the gradation and the α value are 100%. In addition, the characteristic of each graph shown in FIGS. 6 and 7 changes with the gamma characteristic.

Figure 8:
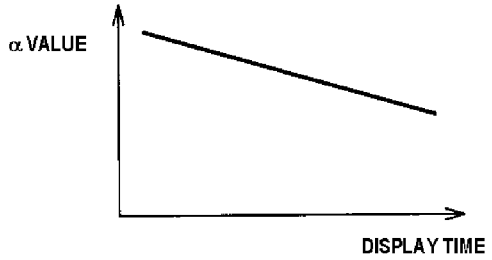
FIG. 8 is a graph showing the relationship between the $\alpha$ value and a display time in a self-luminous indicator.

On the basis of the graphs shown in FIGS. 5 to 7, the relationship between the display time and the α value shown in FIG. 8 is derived. Moreover, the α value information, such as an α value table and an α value expression, is created on the basis of the graph showing the relationship between the display time and the α value shown in FIG. 8 and is then stored in advance in the ROM 12. Accordingly, by measuring the display time of the indicator 15, the α value for specifying the adjustment brightness of the second display portion G12 corresponding to brightness deterioration of the first display portion G11 can be calculated on the basis of the display time and the α value information.

Moreover, regarding the adjustment brightness, various embodiments may also be considered such as predicting the brightness deterioration from a display time and specifying the α value, the adjustment brightness, and the like on the basis of the predicted brightness deterioration and a table, a calculation expression, and the like set in advance.

Then, the CPU 11 executes a display time measuring program, which is stored in advance in the ROM 12, to function as the display time measuring unit P2 shown in FIG. 1. For example, the CPU 11 measures a display time of the indicator 15 at an arbitrary timing and periodically stores the display time information, which indicates the display time or the counter value, on the EEPROM 17.

Next, an example of brightness adjustment processing according to the invention that the CPU 11 of the display device 1 for a vehicle executes will be described with reference to a flow chart shown in FIG. 9. In addition, this brightness adjustment processing is assumed to be called from a high-order module at an arbitrary timing, for example, at a predetermined display time or at predetermined date and time.

Figure 9:
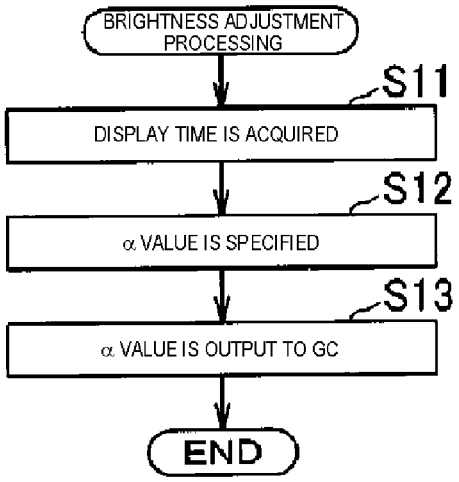
FIG. 9 is a flow chart showing an example of brightness adjustment processing related to the first embodiment of the invention which is executed by a CPU in FIG. 2.

When a brightness adjusting program is executed by the CPU 11, the display time information is acquired from the EEPROM 17 in step S11 shown in FIG. 9. Then, in step S12, a display time, that is, an α value corresponding to the adjustment gradation of the second display portion G12 by which the first and second display portions G11 and G12 have the same brightness is specified on the basis of the display time information and the α value information. Then, in step S13, the α value is output to the GC 14 and the process ends.

As is also apparent from the above explanation, in the first embodiment, the CPU 11 functions as the adjustment gradation specifying unit P3 shown in FIG. 1 by executing the brightness adjusting program described above.

Next, an example of the operation of the display device 1 for a vehicle according to the invention will be described with reference to FIGS. 3, 4, and 10.

When the display device 1 for a vehicle is started by ON of an ignition switch of a vehicle or the like, the display device 1 for a vehicle displays the first image information G1 on the display screen 15*a* of the indicator 15 such that fixed display of the first display portion G11 equivalent to a design pattern of a speedometer is performed with high brightness and the second display portion G12 equivalent to the background is in a non-display state, such as black, on the display screen 15*a* as shown in FIG. 3. For this reason, in the indicator 15, the display region corresponding to the first display portion G11 deteriorates with temporal change or the like while deterioration of the display region corresponding to the second display portion G12 occurs late. Since the difference of deterioration gradually increases with a display time, a brightness spot is generated between display regions according to the increase.

Moreover, if the display device 1 for a vehicle measures the speed (measured amount) of the vehicle by sampling a speed signal at predetermined sampling intervals, the display device 1 for a vehicle displays the indicating portion G13 on the second display portion G12 in order to indicate a design pattern corresponding to the speed. That is, the display device 1 for a vehicle displays the indicating portion G13 by moving the tip of the indicating portion G13 on the second display portion G12 according to the measured amount so as to follow the design pattern. Thus, since the indicating portion G13 moves according to the measured amount, deterioration of pixel elements corresponding to the movement range of the indicating portion G13 in the second display portion G12 of the indicator 15 also occurs late.

Figure 10:
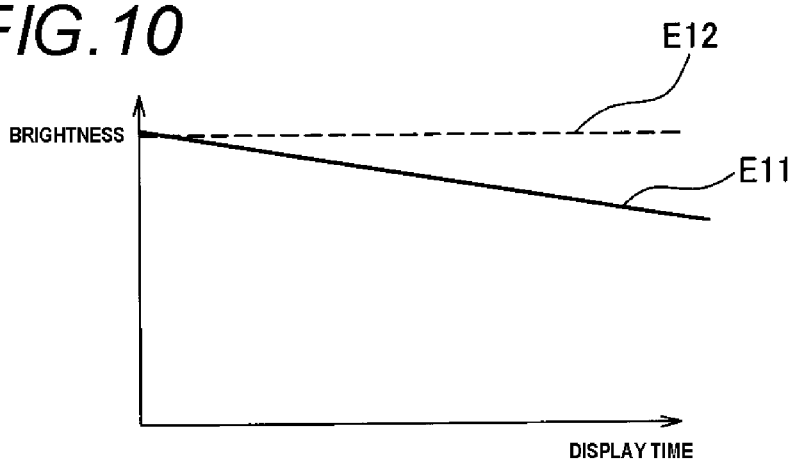
FIG. 10 is a graph showing the relationship between the brightness of each of first and second display regions on a display screen and a display time.

If the indicator 15 of the display device 1 for a vehicle displays the first image information G1 all the time, it can be seen from FIG. 10 that the brightness of the first display region 15*b* deteriorates with the display time while brightness deterioration of the second display region 15*c* occurs late. In FIG. 10, the vertical axis indicates a brightness and the horizontal axis indicates a display time.

The display device 1 for a vehicle measures a display time of the indicator 15, specifies the α value (adjustment brightness) corresponding to brightness deterioration of the first display region 15*b* according to the display time, and displays the first image information G1 and the transmissive image information, in which a portion equivalent to the second display region 15*c* is the α value, on the indicator 15 after alpha blending. On the display screen 15*a*, the transmittance of the first display region 15*b* which has deteriorated is not 100%, that is, is not alpha blended. Moreover, the transmittance of the second display region 15*c* deterioration of which occurs late becomes 80%, for example, by brightness adjustment performed according to the first display region 15*b* which has deteriorated. Thus, in the invention, it is not necessary to provide a circuit for exclusive use and the like because the α value is specified according to the characteristic of the display screen 15*a* by software.

Moreover, when a driver or the like requests display of the second image information G2 through an in-vehicle LAN in a state where non-uniformity of the brightness occurs in the first and second display regions 15*b* and 15*c* of the display screen 15*a*, the display device 1 for a vehicle displays the second image information G2 of the VRAM 16 shown in FIG. 4 and the transmissive image information, which corresponds to the newest α value described above, on the indicator 15 after alpha blending. As a result, since the indicator 15 uniformly adjusts the brightness of the entire screen of the first and second display portions G11 and G12, non-uniformity of the brightness caused by burn-in is unnoticeable in the second image information G2 displayed on the display screen 15*a*.

According to the display device 1 for a vehicle described above, since the brightness in the first display region 15*b* of the first display portion G11 which performs fixed display with high brightness deteriorates with the display time of the self-luminous indicator 15 and brightness deterioration in the second display region 15*c* of the second display portion G12 occurs late, non-uniform brightness deterioration occurs on the display screen 15*a*. However, since an adjustment gradation by which the first and second display portions G11 and G12 have the same brightness is specified on the basis of the display time and the self-luminous indicator 15 is displayed such that the second display region 15*c* of the display screen 15*a* corresponding to the second display portion G12 has the adjustment gradation, the entire display screen 15*a* can be displayed with the same brightness even if non-uniform brightness deterioration (brightness spotting) occurs between the first and second display regions 15*b* and 15*c* of the display screen 15*a* due to temporal change or the like in the display screen 15*a* of the self-luminous indicator 15. Therefore, since it is not necessary to monitor each pixel of the self-luminous indicator 15, non-uniformity of the brightness caused by burn-in can be reduced without complicating the device configuration. Moreover, since the device configuration is not complicated, an increase in device costs can be prevented. As a result, it can also contribute to low-priced vehicles and the like.

Moreover, according to the display device 1 for a vehicle, since the image information obtained by translucently combining the transmissive image information and each image information item is displayed on the self-luminous indicator 15, a portion of the second display region 15*c* of the display screen 15*a* corresponding to the second display portion G12 can be made to have the adjustment brightness by translucent combining of the image information. Accordingly, since brightness adjustment can be performed by using a function of the graphics controller 14 in the related art, it is possible to prevent the device from becoming complicated, and the cost can be reduced by using the existing functions effectively.

Moreover, according to the display device 1 for a vehicle, when changing the display content of the self-luminous indicator 15 from the first image information G1 to the second image information G2, the second image information G2 and the transmissive image information corresponding to the first image information G1 are translucently combined and the result is displayed on the self-luminous indicator 15. Accordingly, even if a brightness spot is generated between the first and second display portions 15*b* and 15*c* on the display screen 15*a* of the self-luminous indicator 15, the second display region 15*c* where deterioration occurs late can be made to have the adjustment brightness on the basis of the transmissive image information. As a result, non-uniform emission caused by burn-in of the display screen 15*a* can be made to be unnoticeable even if the display content of the self-luminous indicator 15 is changed to the second image information G2.

In the first embodiment, the case has been described in which the display device 1 for a vehicle displays the first image information G1 and the second image information G2 while switching them. However, for example, when displaying three or more items of image information, it is possible to set a display region of the display screen 15*a* on the basis of a display time of each item of the image information and to specify the adjustment brightness for adjustment.

Moreover, in the first embodiment, the case has been described in which the temperature detected by the temperature sensor 18 is not used to predict brightness deterioration of the indicator 15. However, the invention is not limited to this, and the adjustment brightness may be specified using various kinds of parameters, such as temperature and a display time of the first image information G1.

It is known that the life of the indicator 15 when used in a low-temperature condition, such as 25° C., is generally longer than that when used in a high-temperature condition, such as 80° C. Accordingly, the temperature of the indicator 15 is measured, and the life conversion information for correcting the display time is created in advance from the relationship between the temperature and the life of the indicator 15. Then, the display device 1 for a vehicle can calculate a display time, which is suitable for the usage environment of the indicator 15, by correcting the display time from the measured temperature and the life conversion information.

For example, when measuring a display time, the display device 1 for a vehicle acquires the temperature detected by the temperature sensor 18, calculates the life of the indicator 15 corresponding to the temperature from the life conversion information, and corrects a display time from the life. Moreover, when it is expected that the calculated life may be shorter than the actual warranty period of the indicator 15, the display device 1 for a vehicle performs correction for increasing the display time, specifies the adjustment gradation by which the first and second display portions G11 and G12 have the same brightness on the basis of the corrected display time, and displays the display region of the display screen 15*a* corresponding to the second display portion G12 on the indicator 15 so as to have the adjustment gradation.

As a result, even if non-uniform brightness deterioration (brightness spotting) occurs between display regions corresponding to the first and second display portions G11 and G12 due to temporal change or the like in the display screen 15*a* of the indicator 15, the entire display screen can be displayed with the same brightness without being influenced by the usage environment of the indicator 15.

Second Embodiment

Hereinafter, a display device for a vehicle according to a second embodiment of the invention will be described with reference to FIGS. 5 to 8 and 11 to 17.

Figure 11:
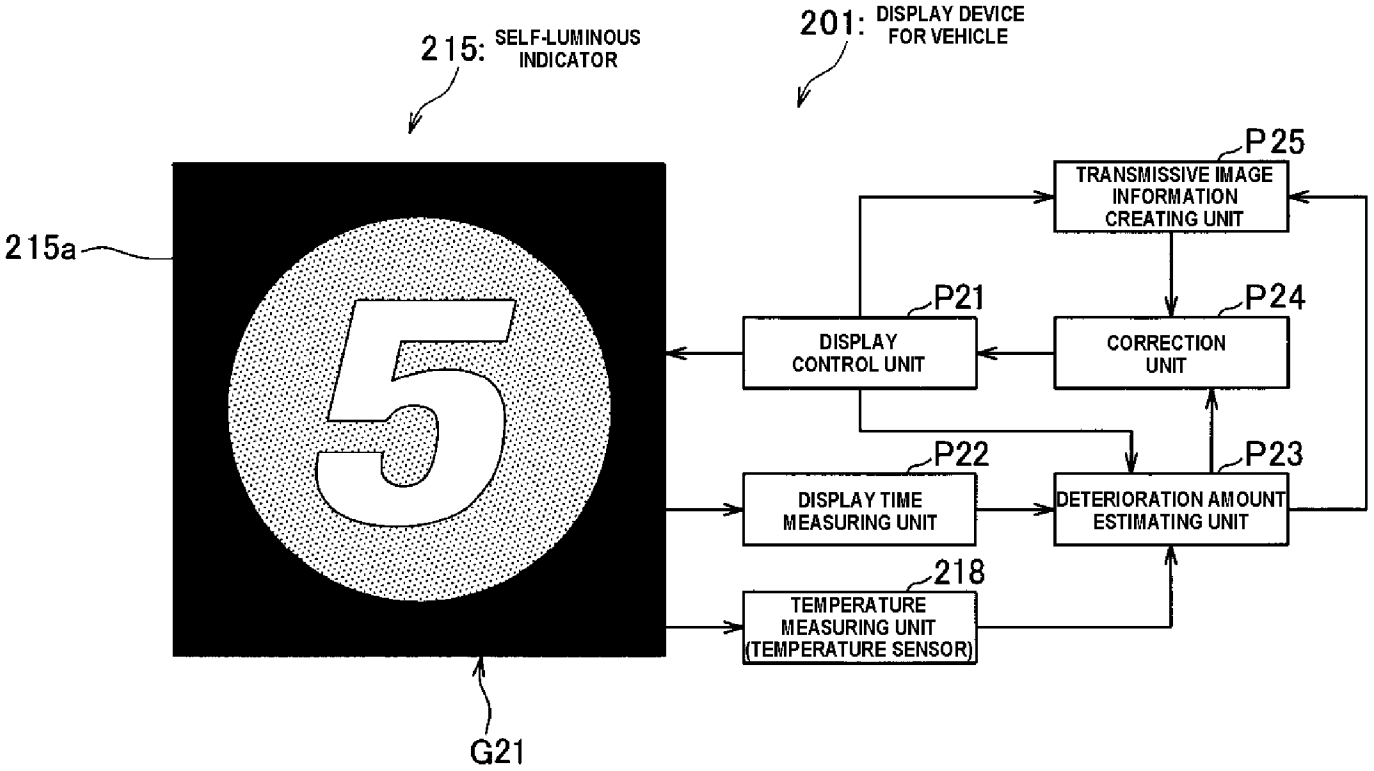
FIG. 11 is a block diagram showing the basic configuration of a display device for a vehicle according to a second embodiment of the invention.

As shown in FIG. 11 which shows the basic configuration, a display device 201 for a vehicle according to the second embodiment of the invention includes: a self-luminous indicator 215 which has a display screen 215*a* with a plurality of pixels; a display control unit P21 that displays the image information indicating a display pattern formed by a plurality of kinds of display colors, on the display screen 215*a* of the self-luminous indicator 215; a display time measuring unit P22 that measures a display time of the self-luminous indicator 215; a deterioration amount estimating unit P23 that estimates the amount of deterioration of a plurality of pixels, which form the display screen 215*a*, on the basis of the display time measured by the display time measuring unit P22 and the display pattern indicated by the image information displayed on the display screen 215*a* by the display control unit P21; and a correction unit P24 that corrects the brightness of each of the plurality of pixels on the basis of the amount of deterioration estimated by the deterioration amount estimating unit P23 so that the plurality of pixels have the same brightness.

According to the display device 201 for a vehicle, when the image information or the like is displayed on the self-luminous indicator 215 by the display control unit P21, a display time of the self-luminous indicator 215 is measured by the display time measuring unit P22. Then, the amount of deterioration of a plurality of pixels which form the display screen is estimated on the basis of the display time and the display pattern of the image information by the deterioration amount estimating unit P23, and the brightness of each of the plurality of pixels is corrected on the basis of the estimated amount of deterioration by the correction unit P24 so that the brightness of the plurality of pixels is the same.

Since the amount of deterioration of a plurality of pixels which form the display screen is estimated on the basis of the display time of the self-luminous indicator and the display pattern of the image information and correction is performed on the basis of the estimated amount of deterioration so that the brightness of the plurality of pixels is the same, the entire display screen can be displayed with the same brightness even if non-uniform brightness deterioration (brightness spotting) occurs between pixels with different colors due to temporal change or the like on the display screen of the self-luminous indicator. Therefore, since it is not necessary to monitor each pixel of the self-luminous indicator using hardware for exclusive use or the like, non-uniformity of the brightness caused by burn-in can be reduced without complicating the device configuration. Moreover, since the device configuration is not complicated, an increase in device costs can be prevented. As a result, it can also contribute to low-priced vehicles and the like. Moreover, under warranty (for example, 10 years) demanded for a vehicle where the display device for a vehicle is mounted, generation of a brightness spot on the display screen can be reduced even if the brightness of the self-luminous indicator deteriorates.

The display device 201 may be configured by comprising a transmissive image information creating unit P25 that is adapted to create transmissive image information in which the image information has certain transparency so that the plurality of pixels have the same brightness, on the basis of the amount of deterioration and each display color of the display pattern indicated by the image information, wherein the correction unit P24 corrects the brightness of each of the plurality of pixels by translucently combining the transmissive image information created by the transmissive image information creating unit with the image information.

According to the display device 201 for a vehicle, after the transmissive image information based on the amount of deterioration and the display color of the image information is created by a transmissive image information creating unit P25, the transmissive image information is translucently combined by the correction unit P24 so that the brightness of each of the plurality of pixels in the self-luminous indicator is corrected.

Since the transmissive image information based on the display color of the image information and the estimated amount of deterioration of each pixel is created and the brightness of each of the plurality of pixels in the self-luminous indicator is corrected by translucently combining the transmissive image information with the image information, deteriorated pixels of the self-luminous indicator can be corrected by translucent combining of the image information. For example, brightness adjustment can be performed by using a function of a graphics controller. Accordingly, it is possible to prevent the device from becoming complicated, and the cost can be reduced by using the existing functions effectively.

The correction unit P24 may be configured to, when the display control unit P21 switches the display content of the self-luminous indicator 215 to second image information G22 which is different from the image information G21, correct the brightness of each of the plurality of pixels by translucently combining the second image information G22 with the transmissive image information.

According to the display device 201 for a vehicle, when changing the display content of the self-luminous indicator 215 from the image information G21 to the second image information G22, the second image information G22 and the transmissive image information are translucently combined by the display control unit P21 and the result is displayed on the self-luminous indicator 215.

When changing the display content of the self-luminous indicator from the image information to the second image information, the second image information and the transmissive image information for correcting deterioration of a pixel are translucently combined and the result is displayed on the self-luminous indicator. Accordingly, even if a brightness spot corresponding to the image information is generated on the display screen of the self-luminous indicator, the region where deterioration occurs late can be made to have the adjustment brightness on the basis of the transmissive image information. As a result, non-uniform emission caused by burn-in of the display screen can be made to be unnoticeable even if the display content of the self-luminous indicator is changed to the second image information.

The display device 201 may be configured by comprising a temperature measuring unit 218 that measures the temperature of the self-luminous indicator 215, wherein the deterioration amount estimating unit P23 corrects the display time from the relationship between the temperature measured by the temperature measuring unit 218 and the life of the self-luminous indicator 215 and estimates the amount of deterioration of the self-luminous indicator on the basis of the corrected display time and the display pattern.

According to the display device 201 for a vehicle, when the temperature of the self-luminous indicator 215 is measured by a temperature measuring unit 218, the actually measured display time is corrected from the relationship between the measured temperature and the life of the self-luminous indicator 215. Regarding the relationship between the temperature and the life of the self-luminous indicator 215, it became clear that the life when the self-luminous indicator 215 was used in a low-temperature condition was longer than that in a high-temperature condition. For this reason, the display time is corrected so as to absorb the difference of life caused by the temperature. Then, the amount of brightness deterioration of the self-luminous indicator 215 based on the corrected display time and the display pattern is estimated by the deterioration amount estimating unit P23.

Since the display time of the self-luminous indicator is corrected to a display time suitable for the temperature and the amount of brightness deterioration of a plurality of pixels, which form a display screen, is estimated on the basis of the corrected display time and the display pattern of image information, the amount of deterioration of the self-luminous indicator can be estimated more precisely. Accordingly, the entire display screen can be displayed with the same brightness without being influenced by the usage environment of the self-luminous indicator.

Figure 12:
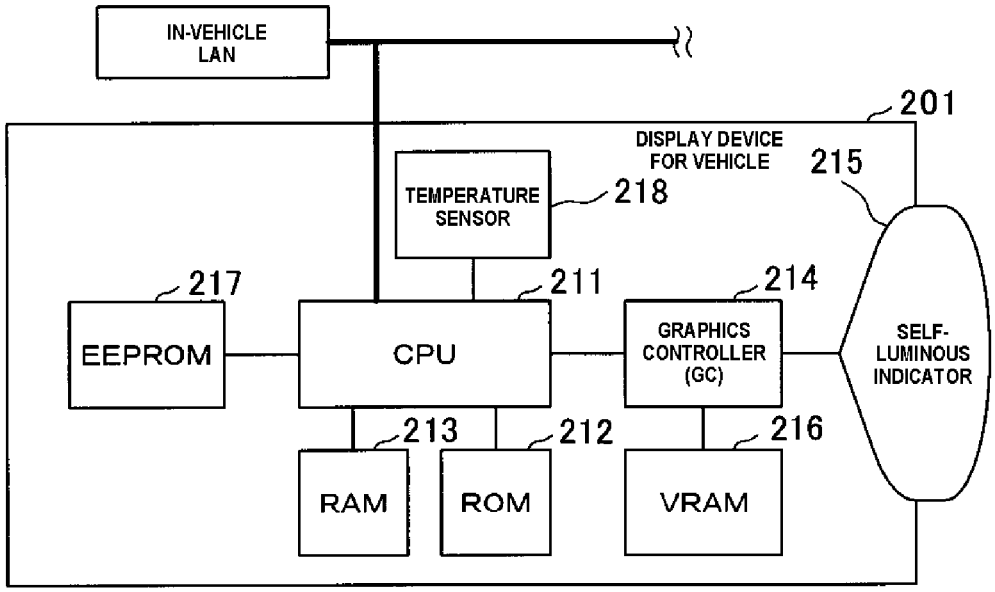
FIG. 12 is a block diagram showing the schematic configuration of the display device for a vehicle according to the second embodiment of the invention.

In FIG. 12, the display device 201 for a vehicle is built in a vehicle as a graphic meter, for example. The display device 201 for a vehicle includes: a central processing unit (CPU) 211 which performs various kinds of processing, control, and the like according to a program set in advance; a ROM 212 which is a read only memory that stores a program for the CPU 211 and the like; a RAM 213 which is a readable and writable memory that stores various kinds of data and has an area required for processing work of the CPU 211; a graphics controller (GC) 214; the self-luminous indicator (also called an indicator) 215; a VRAM (Video Random Access Memory) 216; an EEPROM (Electrically Erasable Programmable Read-Only Memory) 217; and a temperature sensor 218.

The CPU 211 is electrically connected with the ROM 212, the RAM 213, the GC 214, and the temperature sensor 218. In addition, the CPU 211 is communicably connected with an in-vehicle LAN of a vehicle, in which the display device 201 for a vehicle is mounted, through a communication device (not shown). In addition, an indicator 215 and a VRAM 216 are connected to the GC 214 so that various kinds of data can be input and output through a bus.

The ROM 212 stores a program for controlling the entire processing in the display device 201 for a vehicle and the like. The CPU 211 controls display of the indicator 215 by outputting a display request of a given display image to the GC 214 by executing a program. That is, the ROM 212 stores various programs for making the CPU 211 function as various units, such as the display time measuring unit P22 and the deterioration amount estimating unit P23 shown in FIG. 11.

Figure 13:
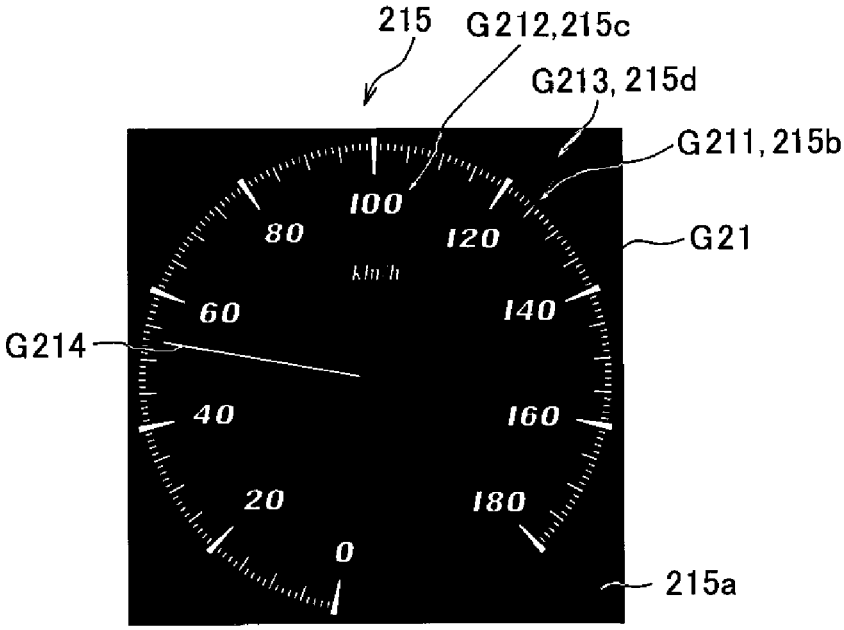
FIG. 13 shows a display example of the image information in the second embodiment of the invention.
Figure 14:
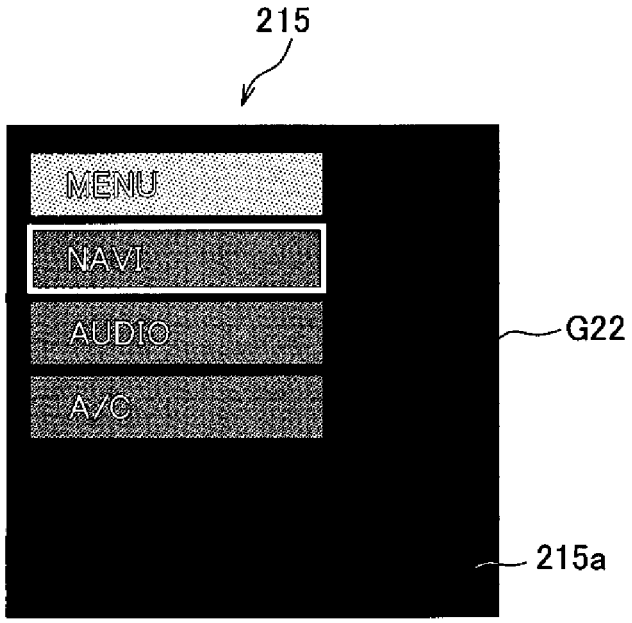
FIG. 14 shows a display example of the second image information in the second embodiment of the invention.

In response to the display request from the CPU 211, the GC 214 performs switching display of the first image information G21 and the second image information G22 on the indicator 215 by drawing each of the first image information G21 shown in FIG. 13 and the second image information G22 shown in FIG. 14 on the basis of various kinds of information (data) of the VRAM 216. Although the case where the GC 214 functions as the display control unit P21 and the correction unit P24 shown in FIG. 11 will be described in the present embodiment, various embodiments may also be considered such as an embodiment, in which the CPU 211 functions as the display control unit P21 and the GC 214 functions only as the correction unit P24, or an embodiment, in which the CPU 211 functions as both the display control unit P21 and the correction unit P24.

The indicator 215 has the display screen 215*a* on which various kinds of image information shown in FIGS. 13 and 14 are displayed, and the display screen 215*a* is provided on an instrument panel of the vehicle so that the driver can view it. In addition, the indicator 215 functions as a known meter by normally displaying the first image information G21 shown in FIG. 13 on the display screen 215*a*. The indicator 215 can draw a character, a figure, and the like on the display screen 215*a* by turning on/off display units (pixels) arrayed in a matrix. That is, the indicator 215 has a configuration capable of performing dot matrix display. For example, a display device, such as an organic EL (Electro Luminescence) device, may be arbitrarily used. In addition, the indicator 215 is configured to perform switching display of the first image information G21, the second image information G22, and the like on the display screen 215*a* by turning on/off each pixel by control of the GC 214.

As is well known, the VRAM 216 shown in FIG. 12 is a memory which stores the content displayed on the indicator 215, and stores various kinds of information involving the first image information G21 and the second image information G22 or the transmissive image information. In addition, the CPU 211 accesses the VRAM 216 through the GC 214.

The first image information G21 is information for displaying a speedometer which is a given display pattern, as shown in FIG. 13. The first image information G21 has: a first display portion G211 which displays a plurality of scale marks circularly arrayed; a second display portion G212 which displays figures corresponding to the scale marks of the first display portion G211 with different display colors from the scale marks; a third display portion G213 equivalent to the background of the first and second display portions G211 and G212; and an indicating portion G214 which is displayed to rotate up to the indicating position of an index corresponding to the measured amount (for example, the speed of a vehicle). In the present embodiment, the case will be described in which a design pattern of a speedometer is used as the given display pattern. However, the invention is not limited to this, and it is arbitrarily defined by the display form of embodiments, such as a tachometer and a fuel gauge.

The first display portion G211 is a region displayed with given high brightness. The second display portion G212 is a region displayed with lower brightness than the first display portion G211. The third display portion G213 is a region which is displayed with lower brightness than the first and second display portions G211 and G212 or is a non-display region. That is, the third display portion G213 is a background of the display pattern. For example, the third display portion G213 is based on a dark color system such as black, dark gray, and dark blue, with lower brightness than the indices. The indicating portion G214 is equivalent to an indicator, such as a known speedometer. The indicating portion G214 is displayed in the shape of an approximately straight line from the center of the first image information G21 toward the first display portion G211 while being updated according to a change in the measured amount or the like in the rotation range set in advance. In addition, the third display portion G213 may be also displayed with a plurality of display colors. For example, a region of the background equivalent to the danger range of an index or the like may be displayed with a warning color.

When the first image information G21 is displayed on the display screen 215*a* of the indicator 215, a portion where the first display portion G211 is displayed is a first display region 215*b*, a portion where the second display portion G212 is displayed is a second display region 215*c*, and a portion where the third display portion G213 is displayed is a third display region 215*d*. Moreover, the indicator 215 controls display of each corresponding pixel element (pixel) of the first, second, and third display regions 215*b*, 215*c*, and 215*d*.

The second image information G22 is an image switched from the first display portion G21, which is normally displayed on the indicator 215, in response to a switching request from a user or at a predetermined switching timing. That is, the second screen information G22 is displayed in the same region as the first screen information G21 on the display screen 215*a* of the indicator 215. In addition, the second image information G22 is image information showing a menu screen for selecting "NAVI (navigation)", "AUDIO", and "A/C (air conditioner)", as shown in FIG. 14.

The transmissive image information shows a region (display pattern) of the display screen 215*a* where brightness deterioration by temporal change or the like occurs late, and is a mask image which is transmitted through portions corresponding to the second and third display portions G212 and G213 so as to have different adjustment brightnesses. The transmissive image information is information capable of specifying an image which defines a portion through which the information is to be transmitted, that is, a background portion of the first display portion G211 corresponding to a display pattern, such as a speedometer, and an image which defines a portion of the second display portion G212 and is used for an alpha blending (α blending) function of the GC 214.

Alpha blending is a function of translucently combining two images using a coefficient (α value). Since alpha blending is already described in the first embodiment, a detailed explanation thereof will be omitted.

In the present embodiment, the case will be described in which the α value is calculated on the basis of brightness deterioration of each of the display regions 215*c* and 215*d* and the transmittance of the display region with respect to each pixel is specified on the basis of the α value in a configuration capable of specifying the second and third display regions 215*c* and 215*d* of the display screen 215*a* corresponding to the second and third display portions G212 and G213 using the transmissive image information. When two α values are input from the CPU 211, the GC 214 creates or extracts the transmissive image information, in which a portion equivalent to the second display portion G212 is a second α value and a portion equivalent to the third display portion G213 is a third α value, and stores it in the VRAM 216. Then, the GC 214 displays the transmissive image information and the first image information G21 of the VRAM 216 on the indicator 215 after alpha blending. As a result, the indicator 215 displays the first image information G21 in which the brightness of the entire screen of the first, second, and third display portions G211, G212, and G213 has been uniformly adjusted. In addition, when the GC 214 receives a switching request from the CPU 211, the GC 214 displays the second image information G22 of the VRAM 216 and the transmissive image information on the indicator 215 after alpha blending.

The temperature sensor 218 has a sensor element provided in the indicator 215. The sensor element outputs a temperature signal corresponding to the temperature of the installation place to the CPU 211. In addition, the CPU 211 is configured to be able to detect the temperature of the indicator 215 on the basis of the temperature signal from the temperature sensor 218 and to use the temperature for determination (prediction) regarding deterioration of the indicator 215 or the like. In addition, the temperature sensor 218 may be removed from the configuration of the display device 201 for a vehicle when the temperature is not used for determination of brightness deterioration.

Next, the relationship between a display time of the indicator 215 and the α value will be described. In addition, since an example of the derivation method was already described in the first embodiment with reference to FIGS. 5 to 8, a detailed explanation thereof will be omitted.

The α value information, such as an α value table and an α value expression, is created on the basis of the graph showing the relationship between the display time and the α value shown in FIG. 8 and is then stored in advance in the VRAM 216 so as to correspond to the second and third α values. Accordingly, by measuring the display time of the indicator 215, the α value for specifying the adjustment brightness of each of the second and third display portions G212 and G213 corresponding to brightness deterioration of the first display portion G211 can be calculated on the basis of the display time and the α value information.

Figure 15A:
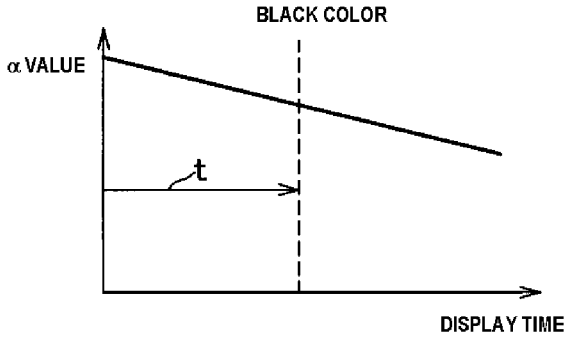
FIGS. 15A to 15C are graphs showing the relationship between the a value and a display time for each display color, where
Figure 15B:
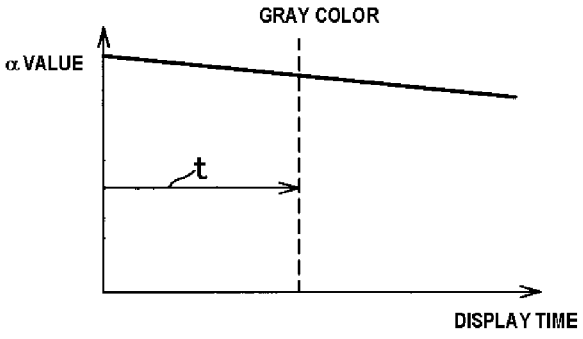
Figure 15C:
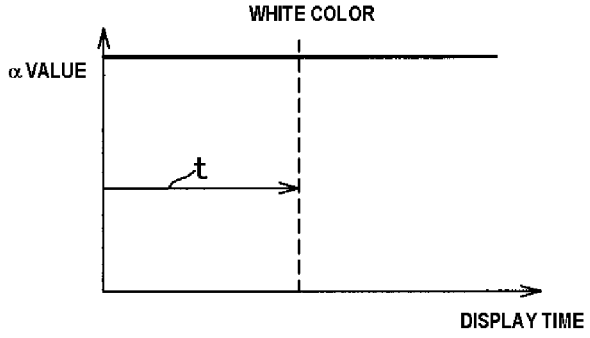

Next, examples of the α value corresponding to each display color and a display time will be described. First, the case where the display color shown in FIG. 15A is black, the case where the display color shown in FIG. 15B is gray, and the case where the display color shown in FIG. 15C is white are compared. When the display color is white, it is almost unnecessary to decrease the α value even if a display time elapses. On the other hand, when the display color is black, it is necessary to decrease the α value gradually with the elapse of a display time. Moreover, when the display color is gray, it is not as black, but it is necessary to decrease the α value gradually with the elapse of a display time. In consideration of such relationship, a table corresponding to a display color, a calculation program, and the like are stored in advance in the VRAM 216.

Moreover, regarding the adjustment brightness, various embodiments may also be considered such as predicting the brightness deterioration from a display time and specifying the α value, the adjustment brightness, and the like on the basis of the predicted brightness deterioration and a table, a calculation expression, and the like set beforehand.

Then, the CPU 211 executes a display time measuring program, which is stored in advance in the ROM 212, to function as the display time measuring unit P22 shown in FIG. 11. For example, the CPU 211 measures a display time of the indicator 215 at an arbitrary timing and periodically stores the display time, which indicates the display time or the counter value, on the EEPROM 217.

Next, an example of brightness adjustment processing according to the invention that the CPU 211 of the display device 201 for a vehicle executes will be described with reference to a flow chart shown in FIG. 16. In addition, this brightness adjustment processing is assumed to be called from a high-order module at the system start of the display device 201 for a vehicle, for example.

Figure 16:
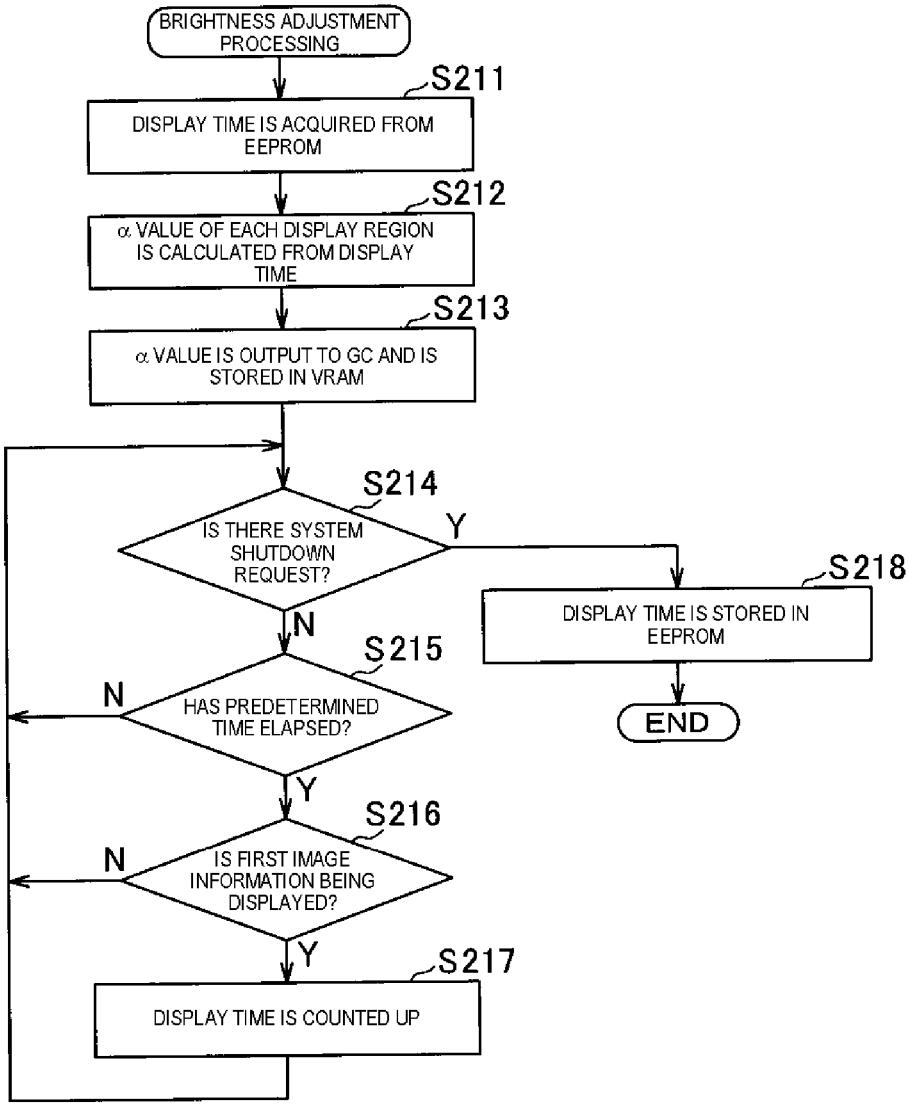
FIG. 16 is a flow chart showing an example of brightness adjustment processing related to the invention which is executed by a CPU in FIG. 12.

If the system of the display device 201 for a vehicle is started and a brightness adjusting program is executed by the CPU 211, a display time is acquired from the EEPROM 217 and is then stored in the RAM 213 in step S211 shown in FIG. 16. Then, the process proceeds to step S212.

In step S212, the cumulative amount of deterioration corresponding to each of the plurality of pixels is estimated from the display time of the RAM 213 for every display region, and an α value is calculated from the cumulative amount of deterioration and is then stored in the VRAM 216. Then, the process proceeds to step S213. In this processing, the second and third α values of the second and third display portions G212 and G213 by which the first, second, and third display portions G211, G212, and G213 have the same brightness are specified (calculated) on the basis of the display time and the cumulative amount of deterioration and are then stored in the VRAM 216. Moreover, in the present embodiment, the α value information is prepared in advance so that the α value can be specified from a display time. Accordingly, the processing can be made simple by using it.

In step S213, the α value information indicating the second α value, the third α value, and the like is output to the GC 214, the α value information is stored in the VRAM 216, and the indicator 215 is displayed by a control based on the α value information of the GC 214. Then, the process proceeds to step S214. In addition, since brightness deterioration progresses slowly, outputting the α value information to the GC 214 may be performed once at the time of system startup. However, the α value information may be output to the GC 214 at an arbitrary timing.

In step S214, it is determined whether or not a system shutdown request has been received. If it is determined that a system shutdown request has not been received (N in step S214), it is determined whether or not a predetermined time has elapsed in step S215. In addition, the predetermined time is a sampling time set in advance. In the present embodiment, it is determined using a clock function, a timer function, and the like of the CPU 211. If it is determined that a predetermined time has not elapsed (N in step S215), the process returns to step S214 to repeat a series of processes. On the other hand, if it is determined that a predetermined time has elapsed (Y in step S215), the process proceeds to step S216.

In step S216, it is determined whether or not the first image information G21 is being displayed on the basis of whether or not the first image information G21 is displayed on the indicator 215. If it is determined that the first image information G21 is not being displayed (N in step S216), the process returns to step S214 to repeat a series of processes. On the other hand, if it is determined that the first image information G21 is being displayed (Y in step S216), a display time of the RAM 213 is counted up by the predetermined time in step S217. Then, the process proceeds to step S214.

On the other hand, if it is determined that a system shutdown request has been received in step S214 (Y in step S214), the display time of the RAM 213 is stored in the EEPROM 217 in step S218, and the process ends. Thus, since the display time is stored in the EEPROM 217, it is not necessary to store the amount of deterioration for every display portion. As a result, it is possible to make a process simple and to reduce the capacity of a storage region.

As is also apparent from the above explanation, in the present embodiment, the CPU 211 functions as the display time measuring unit P22 and the deterioration amount estimating unit P23 shown in FIG. 11 by executing the brightness adjusting program described above.

Next, an example of the operation of the display device 201 for a vehicle according to the invention will be described with reference to FIGS. 13, 14, and 16.

When a system of the display device 201 for a vehicle is started by ON of an ignition switch of a vehicle or the like, the display device 201 for a vehicle displays the first image information G21 on the display screen 215*a* of the indicator 215 such that fixed display of the first display portion G211 equivalent to a design pattern of a speedometer is performed with high brightness and the second display portion G212 equivalent to the background is in a non-display state, such as black, on the display screen 215*a* as shown in FIG. 13. Accordingly, on the indicator 215, the first display region 215*b* corresponding to the first display portion G211 deteriorates with temporal change or the like, while deterioration of the second display region 215*c* corresponding to the second display portion G212 occurs late because the brightness of the second display region 215*c* is lower than that of the first display region 215*b*. In addition, deterioration of the third display region 215*d* corresponding to the third display portion G213 occurs later than the second display region 215*c*. Since the difference of deterioration gradually increases with a display time, a brightness spot is generated between display regions according to the increase.

Moreover, if the display device 201 for a vehicle measures the speed (measured amount) of the vehicle by sampling a speed signal at predetermined sampling intervals, the display device 201 for a vehicle displays the indicating portion G214 on the third display portion G213 in order to indicate a design pattern corresponding to the speed. That is, the display device 201 for a vehicle displays the third display portion G213 by moving the tip of the indicating portion G214 on the third display portion G213 according to the measured amount so as to follow the design pattern. Thus, since the indicating portion G214 moves according to the measured amount, deterioration of pixel elements corresponding to the movement range of the indicating portion G214 in the third display portion G213 of the indicator 215 also occurs late.

Figure 17:
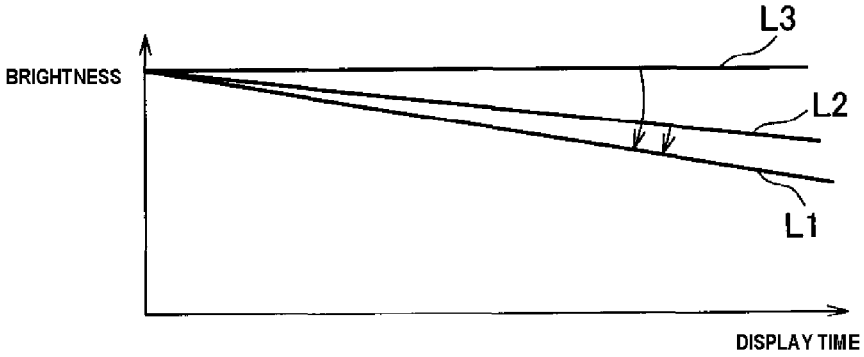
FIG. 17 is a graph showing the relationship between the brightness of each of first to third display regions on a display screen and a display time.

If the indicator 215 of the display device 201 for a vehicle displays the first image information G21 all the time, it can be seen from FIG. 17 that the first display region 215*b* deteriorates like a graph L1 with a display time, the second display region 215*c* deteriorates like a graph L2 so as to follow the graph L1, the third display region 215*d* hardly deteriorates like a graph L3. In FIG. 16, the vertical axis indicates a brightness and the horizontal axis indicates a display time. Accordingly, non-uniformity of the brightness can be solved by adjusting the brightness of each of the second and third display regions 215*c* and 215*d* so as to match that of the first display region 215*b* which has deteriorated most.

For this reason, the display device 201 for a vehicle measures a display time of the indicator 215, calculates the cumulative amount of deterioration, which indicates brightness deterioration of each of the first and second display regions 215*b* and 215*c*, according to the display time, for example, at the time of system startup or at an arbitrary timing, specifies an α value (amount of correction) of each of the second and third display regions 215*c* and 215*d* corresponding to the cumulative amount of deterioration, creates the transmissive image information in which a portion equivalent to the second display region 215*c* is a second α value and a portion equivalent to the third display region 215*d* is a third α value, and displays the transmissive image information and the first image information G21 on the indicator 215 after alpha blending.

As a result, on the display screen 215*a*, the transmittance of the first display region 215*b* which has deteriorated is not 100%, that is, is not alpha blended. Moreover, the transmittance of the second display region 215*c* deterioration of which occurs late becomes 95%, for example, by brightness adjustment performed according to the first display region 215*b* which has deteriorated. In addition, the transmittance of the third display region 215*d* deterioration of which occurs late becomes 80%, for example, by brightness adjustment performed according to the first display region 215*b* which has deteriorated. Thus, in the invention, it is not necessary to provide a circuit for exclusive use and the like because the α value is specified according to the characteristic of the display screen 215*a* by software.

Moreover, when a driver or the like requests display of the second image information G22 through an in-vehicle LAN in a state where non-uniformity of the brightness occurs in the first, second, and third display regions 215*b*, 215*c*, and 215*d* of the display screen 215*a*, the display device 201 for a vehicle displays the second image information G22 of the VRAM 216 and the transmissive image information, which corresponds to the newest α value described above, on the indicator 215 after alpha blending. As a result, since the indicator 215 uniformly adjusts the brightness of the entire screen of the first, second, and third display portions G211, G212, and G213, non-uniformity of the brightness caused by burn-in is unnoticeable in the second image information G22 displayed on the display screen 215*a*.

According to the display device 201 for a vehicle, since the amount of deterioration of a plurality of pixels which form the display screen 215*a* is estimated on the basis of the display time of the self-luminous indicator 215 and the display pattern of the image information and correction is performed on the basis of the estimated amount of deterioration so that the brightness of the plurality of pixels is the same, the entire display screen 215*a* can be displayed with the same brightness even if non-uniform brightness deterioration (brightness spotting) occurs between pixels with different colors due to temporal change or the like on the display screen 215*a* of the self-luminous indicator 215. Therefore, since it is not necessary to monitor each pixel of the self-luminous indicator 215 using hardware for exclusive use or the like, non-uniformity of the brightness caused by burn-in can be reduced without complicating the device configuration. Moreover, since the device configuration is not complicated, an increase in device costs can be prevented. As a result, it can also contribute to low-priced vehicles and the like. Moreover, under warranty (for example, 10 years) demanded for a vehicle where the display device for a vehicle is mounted, generation of a brightness spot on the display screen can be reduced even if the brightness of the self-luminous indicator deteriorates.

Moreover, according to the display device 201 for a vehicle, since the transmissive image information based on the display color of the first image information G21 and the estimated amount of deterioration of each pixel is created and the brightness of each of the plurality of pixels in the self-luminous indicator 215 is corrected by translucently combining the transmissive image information with the first image information G21, deteriorated pixels of the self-luminous indicator 215 can be corrected by translucent combining of the first image information G21. For example, brightness adjustment can be performed by using a function of a graphics controller. Accordingly, it is possible to prevent the device from becoming complicated, and the cost can be reduced by using the existing functions effectively.

Moreover, according to the display device 201 for a vehicle, when changing the display content of the self-luminous indicator 215 from the first image information G21 to the second image information G22, the second image information G22 and the transmissive image information corresponding to the first image information G21 are translucently combined and the result is displayed on the self-luminous indicator 215. Accordingly, even if a brightness spot is generated between the first, second, and third display portions 215*b*, 215*c*, and 215*d* on the display screen 215*a* of the self-luminous indicator 215, the second and third display regions 215*c* and 215*d* where deterioration occurs late can be made to have the adjustment brightness on the basis of the transmissive image information. As a result, non-uniform emission caused by burn-in of the display screen 215*a* can be made to be unnoticeable even if the display content of the self-luminous indicator 215 is changed to the second image information G22.

In the second embodiment, the case has been described in which the display device 201 for a vehicle displays the first image information G21 and the second image information G22 while switching them. However, for example, when displaying three or more items of image information, it is possible to set a display region of the display screen 215*a* on the basis of a display time of each item of the image information and to specify the adjustment brightness for adjustment.

Moreover, in the second embodiment, the case has been described in which the first display portion G211 equivalent to scale marks of the first image information G21 is displayed with higher gradation (display color) than the second display portion G212 equivalent to figures and units. However, the second display portion G212 may be displayed with higher gradation than the first display portion G211. Moreover, when four or more gradations of different levels are set, it is possible to match them by estimating the amount of deterioration for every gradation and specifying the α value corresponding to the amount of deterioration.

Moreover, in the second embodiment, the case has been described in which the CPU 211 executes the brightness adjustment processing shown in FIG. 16 at the time of system startup. Instead, an embodiment may also be adopted in which the CPU 211 executes brightness adjustment processing multiple times at an arbitrary timing while the display device 201 for a vehicle is operating.

Moreover, also in the second embodiment described above, the temperature detected by the temperature sensor 218 may be used to predict brightness deterioration similar to the first embodiment.

For example, when measuring a display time, the display device 201 for a vehicle acquires the temperature detected by the temperature sensor 218, calculates the life of the indicator 215 corresponding to the temperature from the life conversion information, and corrects a display time from the life. In addition, when it is expected that the calculated life may be shorter than the actual warranty period of the indicator 215, the display device 201 for a vehicle performs correction for increasing the display time and estimates the amount of deterioration of the indicator 215 based on the corrected display time and the display pattern. Accordingly, since the amount of deterioration of the self-luminous indicator can be estimated more precisely, the entire display screen can be displayed with the same brightness without being influenced by the usage environment of the self-luminous indicator.

Third Embodiment

Hereinafter, a display device for a vehicle according to a third embodiment of the invention will be described with reference to FIGS. 18 to 24.

Figure 18:
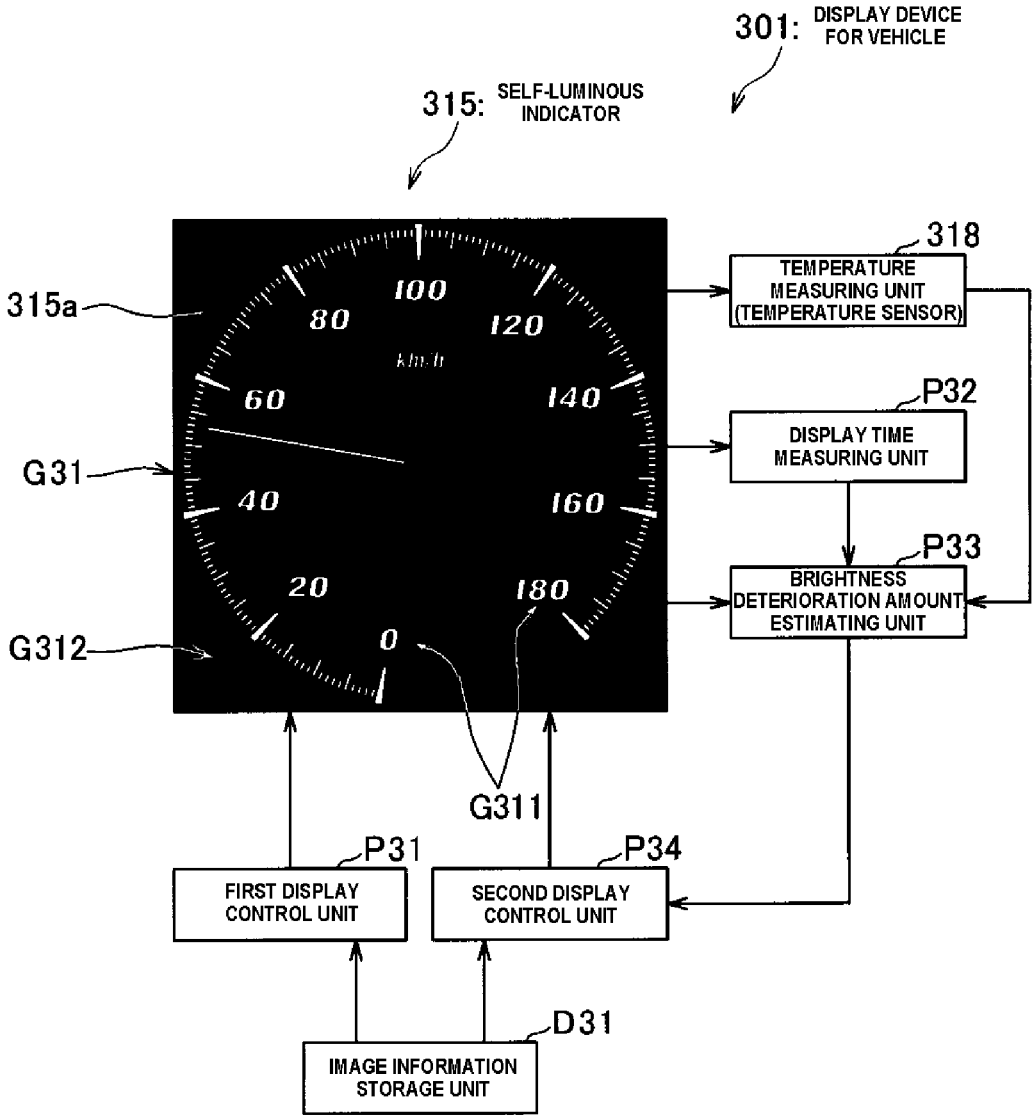
FIG. 18 is a block diagram showing the basic configuration of a display device for a vehicle according to a third embodiment of the invention.

As shown in FIG. 18 which shows the basic configuration, a display device 301 for a vehicle according to the third embodiment of the invention includes: a self-luminous indicator 315 which has a display screen 315*a* with a plurality of pixels; an image information storage unit D31 that stores the image information for setting the gradation of each of the plurality of pixels corresponding to a display pattern; a first display control unit P31 that displays the image information on the display screen 315*a* with a brightness corresponding to the initial gradation which is lower than the gradation set by the image information; a display time measurement unit P32 that measures a display time of the self-luminous indicator 315; a brightness deterioration amount estimating unit P33 that estimates the amount of brightness deterioration of each of the plurality of pixels on the basis of the display time measured by the display time measurement unit P32; and a second display control unit P34 that displays the image information on the display screen 315*a* with a correction gradation, which is obtained by correction from the initial gradation to the high gradation set by the image information, according to the amount of brightness deterioration estimated by the brightness deterioration amount estimating unit P33.

According to the display device 301 for a vehicle, the image information is displayed on the display screen 315*a* of the self-luminous indicator 315 with a brightness corresponding to the initial gradation which is lower than the gradation that the image information sets by the first display control unit P31. Moreover, on the basis of the display time of the self-luminous indicator 315 measured by the display time measurement unit P32, the amount of brightness deterioration of the self-luminous indicator 315 is estimated by the brightness deterioration amount estimating unit P33. Moreover, the image information is displayed on the display screen 315*a* with a correction gradation, which is obtained by correction from the initial gradation to the high gradation set by the image information, according to the amount of brightness deterioration by the second display control unit P34. That is, when the first display control unit P31 controls the display of the self-luminous indicator 315 and performs correction according to the amount of brightness deterioration, the display of the self-luminous indicator 315 is controlled by the second display control unit P34.

Since the display screen is displayed with the initial gradation which is lower than the gradation indicated by the image information, the amount of brightness deterioration is estimated on the basis of the display time, and the image information is displayed on the display screen according to the amount of brightness deterioration with the correction gradation obtained by correction from the initial gradation to the high gradation, the brightness can be kept constant by increasing the gradation according to the amount of brightness deterioration of the self-luminous indicator. As a result, the display can be performed with the same brightness from the beginning of use even if the brightness of the self-luminous indicator deteriorates with temporal change or the like. Therefore, it is possible to delay the deterioration by suppressing the gradation at the start of use of the self-luminous indicator and to keep displaying the display screen with a fixed brightness without complicating the device configuration. Moreover, since the device configuration is not complicated, an increase in device costs can be prevented. As a result, it can also contribute to low-priced vehicles and the like.

The initial gradation may be a gradation level which is lower than a gradation set by the image information within a warranty period of the display device.

According to the display device 301 for a vehicle, even if the second display control unit P34 corrects the gradation to a higher gradation than the initial gradation according to the amount of brightness deterioration, exceeding the gradation set by the image information can be prevented within the warranty period.

Since exceeding the gradation set by the image information can be prevented within the warranty period even if the gradation is corrected to a higher gradation than the initial gradation according to the amount of brightness deterioration of the self-luminous indicator, the display screen can be reliably displayed with a fixed brightness continuously within the warranty period.

The display device 301 may be configured by comprising a temperature measuring unit 318 that measures the temperature of the self-luminous indicator 315, wherein the brightness deterioration amount estimating unit P33 corrects the display time from the relationship between the temperature measured by the temperature measuring unit 318 and the life of the self-luminous indicator 315 and estimates the amount of brightness deterioration of the self-luminous indicator 315 on the basis of the corrected display time.

According to the display device 301 for a vehicle, when the temperature of the self-luminous indicator 315 is measured by a temperature measuring unit 318, the actually measured display time is corrected from the relationship between the measured temperature and the life of the self-luminous indicator 315. Regarding the relationship between the temperature and the life of the self-luminous indicator 315, it became clear that the life when the self-luminous indicator 315 was used in a low-temperature condition was longer than that in a high-temperature condition. For this reason, the display time is corrected so as to absorb the difference of life caused by the temperature. Then, the amount of brightness deterioration of the self-luminous indicator 315 based on the corrected display time is estimated by the brightness deterioration amount estimating unit P33.

Since the display time of the self-luminous indicator is corrected to a display time suitable for the temperature and the amount of brightness deterioration is estimated on the basis of the corrected display time, the amount of brightness deterioration of the self-luminous indicator can be more precisely estimated. As a result, correction to the correction gradation suitable for the usage environment of the self-luminous indicator or the like becomes possible.

The display device 301 may be configured in that the image information has a first display portion G311 fixedly displaying the given display pattern, and a second display portion G312 which is formed in a different region from the first display portion G311 and has lower brightness than the first display portion G311, and the second display control unit P34 translucently combines the image information G31 with transmissive image information in which a portion corresponding to the first display portion G311 has certain transparency so as to have the correction gradation and displays the combined image on the self-luminous indicator 315.

According to the display device 301 for a vehicle, the image information G31 and the transmissive image information in which a portion corresponding to the first display portion G311 of the image information G31 has a correction gradation are translucently combined by the second display control unit P34, and the result is displayed on the image information G31 displayed on the self-luminous indicator 315. Thus, the brightness of the self-luminous indicator 315 is corrected.

Since the gradation of each pixel is corrected by translucent combining of the transmissive image information and the image information, the portion corresponding to the first display portion can be made to have the correction gradation by translucent combining of the image information. For example, the gradation can be corrected by using a function of a graphics controller. Accordingly, it is possible to prevent the device from becoming complicated, and the cost can be reduced by using the existing functions effectively.

Figure 19:
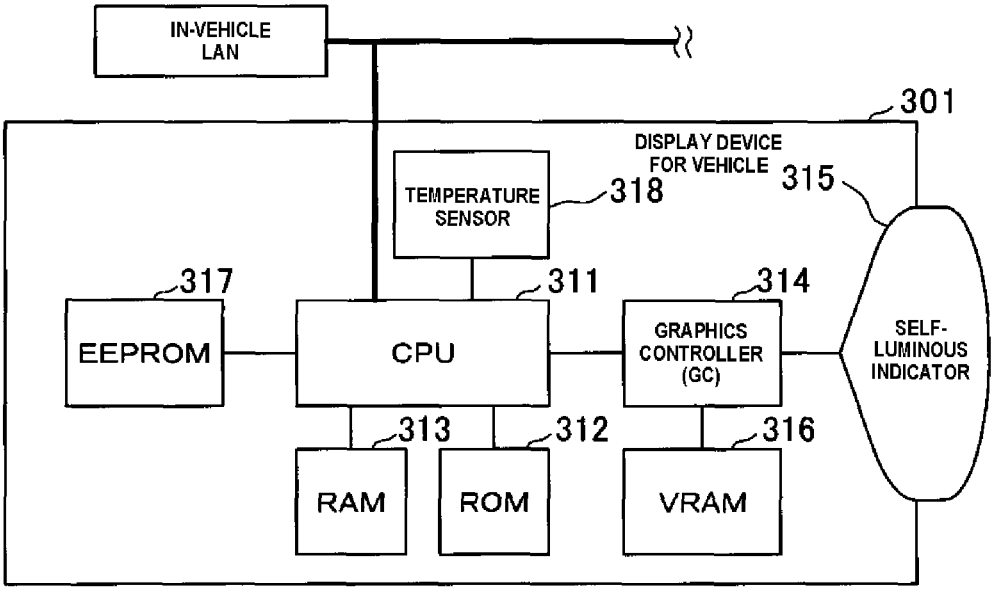
FIG. 19 is a block diagram showing the schematic configuration of the display device for a vehicle according to the third embodiment of the invention.

In FIG. 19, the display device 301 for a vehicle is built in a vehicle as a graphic meter, for example. The display device 301 for a vehicle includes: a central processing unit (CPU) 311 which performs various kinds of processing, control, and the like according to a program set in advance; a ROM 312 which is a read only memory that stores a program for the CPU 311 and the like; a RAM 313 which is a readable and writable memory that stores various kinds of data and has an area required for processing work of the CPU 311; a graphics controller (GC) 314; the self-luminous indicator (also called an indicator) 315; a VRAM (Video Random Access Memory) 316; an EEPROM (Electrically Erasable Programmable Read-Only Memory) 317; and a temperature sensor 318.

The CPU 311 is electrically connected with the ROM 312, the RAM 313, the GC 314, and the temperature sensor 318. In addition, the CPU 311 is communicably connected with an in-vehicle LAN of a vehicle, in which the display device 301 for a vehicle is mounted, through a communication device (not shown). In addition, an indicator 315 and a VRAM 316 are connected to the GC 314 so that various kinds of data can be input and output through a bus.

The ROM 312 stores a program for controlling the entire processing in the display device 301 for a vehicle and the like. The CPU 311 controls display of the indicator 315 by outputting a display request of a given display image to the GC 314 by executing a program. That is, the ROM 312 stores various programs for making the CPU 311 function as various units, such as the display time measuring unit P32 and the brightness deterioration amount estimating unit P33 shown in FIG. 18.

Figure 20:
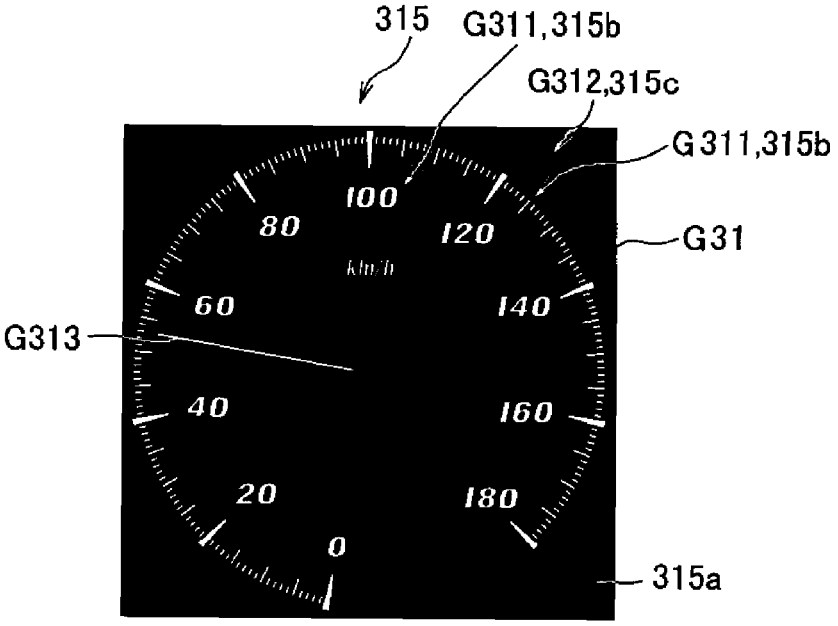
FIG. 20 shows a display example of the image information in the third embodiment of the invention.
Figure 21:
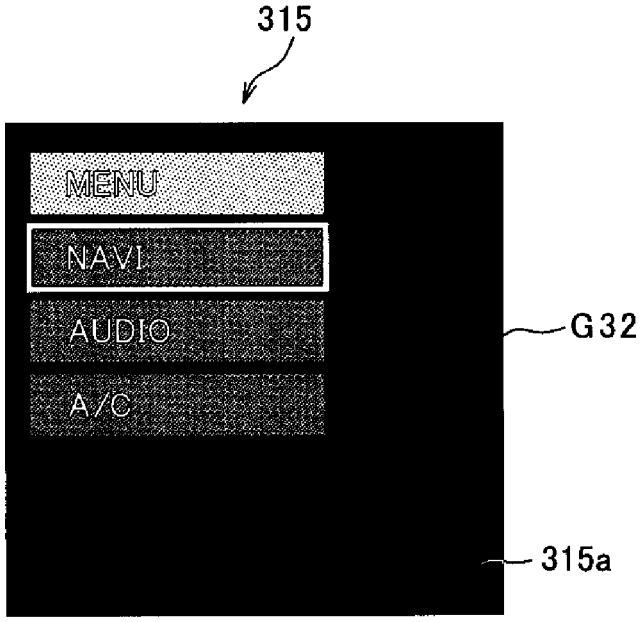
FIG. 21 shows a display example of the second image information in the third embodiment of the invention.

In response to the display request from the CPU 311, the GC 314 performs switching display of the first image information G31 and the second image information G32 on the indicator 315 by drawing each of the first image information G31 shown in FIG. 20 and the second image information G32 shown in FIG. 21 on the basis of various kinds of information (data) of the VRAM 316. Moreover, although the case where the GC 314 functions as the first and second display control units P31 and P34 shown in FIG. 18 is described in the present embodiment, various embodiments, such as making the CPU 311 function as at least one of the first and second display control units P31 and P34, may also be considered.

The indicator 315 has the display screen 315*a* on which various kinds of image information shown in FIGS. 20 and 21 are displayed, and the display screen 315*a* is provided on an instrument panel of the vehicle so that the driver can view it. In addition, the indicator 315 functions as a known meter by normally displaying the first image information G31 shown in FIG. 20 on the display screen 315*a*. The indicator 315 can draw a character, a figure, and the like on the display screen 315*a* by turning on/off display units (pixels) arrayed in a matrix. That is, the indicator 315 has a configuration capable of performing dot matrix display. For example, a display device, such as an organic EL (Electro Luminescence) device, may be arbitrarily used. In addition, the indicator 315 is configured to perform switching display of the first image information G31, the second image information G32, and the like on the display screen 315*a* by turning on/off each pixel by control of the GC 314.

As is well known, the VRAM 316 shown in FIG. 19 is a memory which stores the content displayed on the indicator 315, and stores various kinds of information involving the first image information G31 and the second image information G32 or the transmissive image information. Therefore, in the present embodiment, the VRAM 316 functions as the image information storage unit D31 shown in FIG. 18.

The first image information G31 is image information for setting the gradation of each of a plurality of pixels which form the indicator 315 corresponding to a given display pattern. As shown in FIG. 20, the first image information G31 includes: the first display portion G311 for fixedly displaying the display pattern; the second display portion G312 which is formed in a different region from the first image information G311 and has lower brightness than the first image information G311; and an indicating portion G313 which is displayed to rotate up to the indicating position of an index corresponding to the measured amount. In the present embodiment, the case will be described in which a design pattern of a speedometer is used as the given display pattern. However, the invention is not limited to this, and it is arbitrarily defined by the display form of embodiments, such as a tachometer and a fuel gauge.

The first display portion G311 is a region where a plurality of scale marks and indices, such as a figure and a unit, are displayed with given brightness. The second display portion G312 is a background of the display pattern. For example, the second display portion G312 is based on a dark color system such as black, dark gray, and dark blue, with lower brightness than the indices. The second display portion G312 may be also displayed with a plurality of display colors. For example, a region of the background equivalent to the danger range of an index may be displayed with a warning color. The indicating portion G313 is equivalent to an indicator, such as a known speedometer. The indicating portion G313 is displayed in the shape of a straight line from the center of the first image information G31 toward the first display portion G311 while being updated according to a change in the measured amount or the like in the rotation range set in advance.

When the first image information G31 is displayed on the display screen 315*a* of the indicator 315, a portion where the first display portion G311 is displayed is a first display region 315*b* and a portion where the second display portion G312 is displayed is a second display region 315*c*. Moreover, the indicator 315 controls the display of each corresponding pixel element of the first and second display regions 315*b* and 315*c*. When displaying the first image information G31, the indicator 315 displays pixels of the first display region 315*b* with high brightness and displays pixels of the second display region 315*c* with low brightness or turns off the pixels of the second display region 315*c*.

The second image information G32 is an image switched from the first display portion G31, which is normally displayed on the indicator 315, in response to a switching request from a user or at a predetermined switching timing. That is, the second screen information G32 is displayed in the same region as the first screen information G31 on the display screen 315*a* of the indicator 315. In addition, the second image information G32 is image information showing a menu screen for selecting "NAVI (navigation)", "AUDIO", and "A/C (air conditioner)", as shown in FIG. 21.

The transmissive image information is information which is transmitted through a portion of the first image information G31 corresponding to the second display portion G312 so as to have a correction gradation. The transmissive image information shows a region (display pattern) of the display screen 315*a* where the brightness deteriorates with temporal change or the like, and is a mask image transmitted so that the first display portion G311 of the first image information G31 has a correction gradation corresponding to the amount of brightness deterioration. The transmissive image information is information capable of specifying an image which defines a portion whose gradation is to be corrected, that is, the first display portion G311 corresponding to a display pattern, such as a speedometer, and is used for an alpha blending (α blending) function of the GC 314.

Alpha blending is a function of translucently combining two images using a coefficient (α value). Since the alpha blending is already described in the first embodiment, a detailed explanation thereof will be omitted.

In the present embodiment, therefore, the case will be described in which the α value is calculated on the basis of the amount of brightness deterioration and the transmittance of the first display region 315*b* with respect to each pixel is specified on the basis of the α value in a configuration capable of specifying the first display region 315*b* of the display screen 315*a* corresponding to the first display portion G311 by the transmissive image information. When the α value is input from the CPU 311, the GC 314 creates or extracts the transmissive image information, in which a portion equivalent to the first display portion G311 is the α value, and stores it in the VRAM 316. Then, the GC 314 displays the transmissive image information and the first image information G31 of the VRAM 316 on the indicator 315 after alpha blending. Thus, the indicator 315 can keep the brightness constant in the first display region 315*b* of the display screen 315*a* by displaying the gradation of the first display portion G311 with the correction gradation obtained by correction according to the amount of brightness deterioration of the first display region 315*b*. In addition, when the GC 314 receives a switching request from the CPU 311, the GC 314 displays the second image information G32 of the VRAM 316 and the transmissive image information on the indicator 315 after alpha blending.

The VRAM 316 stores various kinds of information involving α information with an α value corresponding to the first image information G31 and the brightness deterioration estimation information. In addition, the CPU 311 accesses the VRAM 316 through the GC 314. In addition, the EEPROM 317 stores a display time of the indicator 310 and the like.

The temperature sensor 318 has a sensor element provided in the indicator 315. The sensor element outputs a temperature signal corresponding to the temperature of the installation place to the CPU 311. In addition, the CPU 311 is configured to be able to detect the temperature of the indicator 315 on the basis of the temperature signal from the temperature sensor 318 and to use the temperature for determination (prediction) regarding deterioration of the indicator 315 or the like. In addition, the temperature sensor 18 may be removed from the configuration of the display device 301 for a vehicle when the temperature is not used for determination of brightness deterioration.

Figure 22:
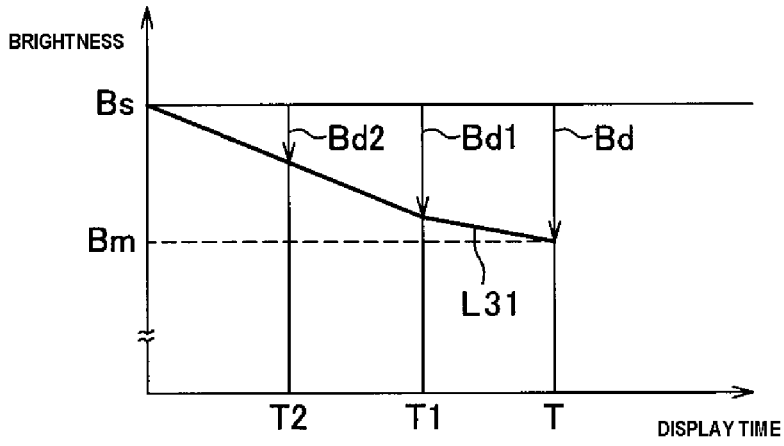
FIG. 22 is a graph showing the deterioration relationship between the brightness and a display time in a self-luminous indicator.

Next, an example of a method of setting the correction brightness within the warranty period of the display device 301 for a vehicle will be described with reference to FIG. 22. In FIG. 22, the vertical axis indicates a brightness and the horizontal axis indicates a display time of the indicator 315.

As shown in a graph L31, when the first display region 315*b* of the indicator 315 shows a brightness characteristic of gradually decreasing from the initial brightness Bs to the brightness Bm with respect to a time equivalent to a warranty period T of the display device 301 for a vehicle, for example, for 10 years, correction for decreasing the gradation of the first display portion G311 of the first image information G31 by the amount of brightness deterioration Bd is performed. Accordingly, a brightness obtained by subtracting the amount of brightness deterioration Bd from the initial brightness Bs is set as the correction brightness at the start of the display device 301 for a vehicle. Moreover, referring to the graph L31, the brightness deterioration estimation information is created on the basis of the amounts of brightness deterioration Bd1 and Bd2 corresponding to arbitrary display time T1 and T2 within the warranty period T and is then stored in the ROM 312 or the like in advance.

In addition, various embodiments may be also considered in which a calculation expression for calculating the α value corresponding to the amount of brightness deterioration from a display time, a conversion table, and the like are used as the brightness deterioration estimation information. In the present embodiment, the case where the gradation of only the first display portion G311 of the first image information G31 is corrected is described for simplicity of explanation. However, the invention is not limited to this, and various embodiments, such as also correcting the gradation of the second display portion G312, may also be considered.

Then, the CPU 311 executes a display time measuring program, which is stored in advance in the ROM 312, to function as the display time measuring unit P32 shown in FIG. 18. For example, the CPU 311 measures a display time of the indicator 315 at an arbitrary timing and periodically stores the display time information, which indicates the display time or the counter value, on the EEPROM 317.

Next, an example of brightness adjustment processing according to the invention that the CPU 311 of the display device 301 for a vehicle executes will be described with reference to a flow chart shown in FIG. 23. In addition, this brightness adjustment processing is assumed to be called from a high-order module at the system start of the display device 301 for a vehicle, for example.

Figure 23:
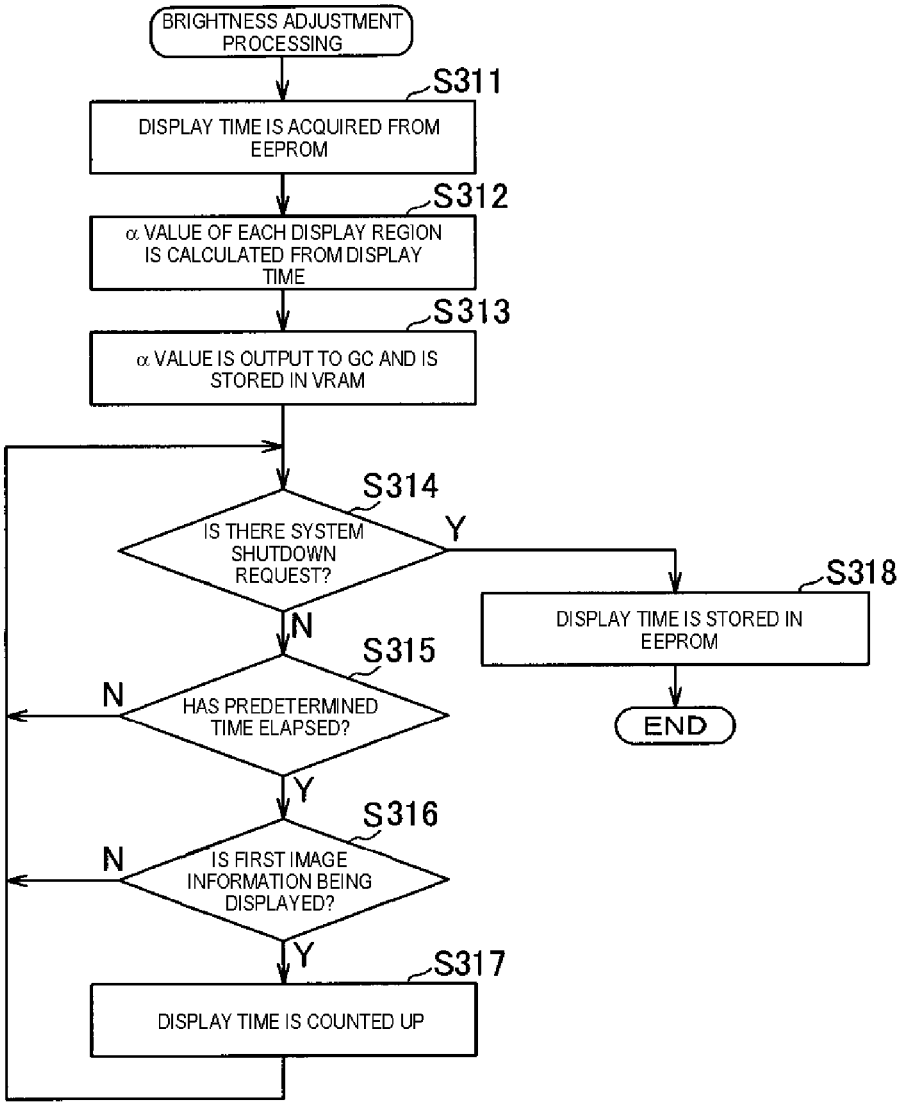
FIG. 23 is a flow chart showing an example of brightness adjustment processing related to the invention which is executed by a CPU in FIG. 19.

If the system of the display device 301 for a vehicle is started and a brightness adjusting program is executed by the CPU 311, a display time is acquired from the EEPROM 317 and is then stored in the RAM 313 in step S311 shown in FIG. 23. Then, the process proceeds to step S312.

In step S312, the cumulative amount of deterioration corresponding to each of the plurality of pixels is estimated from the display time of the RAM 313 and the brightness deterioration estimation information for every display region, and an α value is calculated from the cumulative amount of deterioration and is then stored in the VRAM 316 as α value information. Then, the process proceeds to step S313. In this processing, the second and third α values of the second and third display portions G312 and G313 by which the first, second, and third display portions G311, G312, and G313 have the same brightness are specified (calculated) on the basis of the display time and the cumulative amount of deterioration and are then stored in the VRAM 316. Moreover, in the present embodiment, the brightness deterioration estimation information is prepared in advance so that the a value can be specified from a display time. Accordingly, the processing can be made simple by using it.

In step S313, the α value information indicating the second α value, the third α value, and the like is output to the GC 314, the α value information is stored in the VRAM 316, and the indicator 315 is displayed by control based on the α value information of the GC 314. Then, the process proceeds to step S314. Then, the GC 314 creates or extracts the transmissive image information, in which a portion equivalent to the first display portion G311 is the α value, on the basis of the input α value and stores it in the VRAM 316. Then, the GC 314 displays the transmissive image information and the first image information G31 of the VRAM 316 on the indicator 315 after alpha blending. In addition, since brightness deterioration of the indicator 315 progresses slowly, outputting the α value information to the GC 314 may be performed once at the time of system startup. However, the α value information may be output to the GC 314 at an arbitrary timing.

In step S314, it is determined whether or not a system shutdown request has been received. If it is determined that a system shutdown request has not been received (N in step S314), it is determined whether or not a predetermined time has elapsed in step S315. In addition, the predetermined time is a sampling time set in advance. In the present embodiment, it is determined using a clock function, a timer function, and the like of the CPU 311. If it is determined that a predetermined time has not elapsed (N in step S315), the process returns to step S314 to repeat a series of processes. On the other hand, if it is determined that a predetermined time has elapsed (Y in step S315), the process proceeds to step S316.

In step S316, it is determined whether or not the first image information G31 is being displayed on the basis of whether or not the first image information G31 is displayed on the indicator 315. If it is determined that the first image information G31 is not being displayed (N in step S316), the process returns to step S314 to repeat a series of processes. On the other hand, if it is determined that the first image information G31 is being displayed (Y in step S316), a display time of the RAM 313 is counted up by the predetermined time in step S317. Then, the process proceeds to step S314.

On the other hand, if it is determined that a system shutdown request has been received in step S314 (Y in step S314), the display time of the RAM 313 is stored in the EEPROM 317 in step S318, and the process ends. Thus, since the display time is stored in the EEPROM 317, it is not necessary to store the amount of deterioration for every display portion. As a result, it is possible to make a process simple and to reduce the capacity of a storage region.

As is also apparent from the above explanation, in the present embodiment, the CPU 311 functions as the display time measuring unit P32 and the brightness deterioration amount estimating unit P33 shown in FIG. 18 by executing the brightness adjusting program described above.

Next, an example of the operation of the display device 301 for a vehicle according to the invention will be described with reference to FIGS. 20, 21, and 24.

When the system is started by ON of an ignition switch of a vehicle or the like, the display device 301 for a vehicle estimates the amount of brightness deterioration on the basis of the display time of the EEPROM 317 and the brightness deterioration estimation information and specifies the initial gradation corresponding to the amount of brightness deterioration. Then, the display device 301 for a vehicle creates the transmissive image information corresponding to the initial gradation in the VRAM 316, and starts display of the first image information G31 shown in FIG. 20 by translucently combining the transmissive image information and the first image information G31 and displaying the first display portion G311, which is equivalent to a design pattern of a speedometer, on the display screen 315*a* of the indicator 315. In this case, in the first display region 315*b*, the first image information G31 is displayed with a gradation (brightness) which is corrected to be lower than the gradation set by the first image information G31.

If the display device 301 for a vehicle continues the display of the first image information G31 in this way, the brightness of the first display region 315*b* on the display screen 315*a* corresponding to the first display portion G311 deteriorates with a display time of the indicator 315. Then, the display device 301 for a vehicle measures the display time, estimates the amount of brightness deterioration corresponding to the display time, and specifies an α value corresponding to the amount of brightness deterioration. In addition, the display device 301 for a vehicle translucently combines the transmissive image information corresponding to the α value with the first image information G31 and displays the first image information G31 on the display screen 315*a*. Thus, the brightness of each pixel of the first display region 315*b* on the display screen 315*a* deteriorates with a display time, but correction for increasing the gradation of the first display portion G311 of the first image information G31 by the amount of brightness deterioration is performed. Accordingly, the first display region 315*b* of the display screen 315*a* has the same brightness till then. By correcting the gradation of the first display portion G311 according to the display time as described above, the display device 301 for a vehicle can make the display brightness of the first display region 315*b* uniform at least during the warranty period T.

Figure 24:
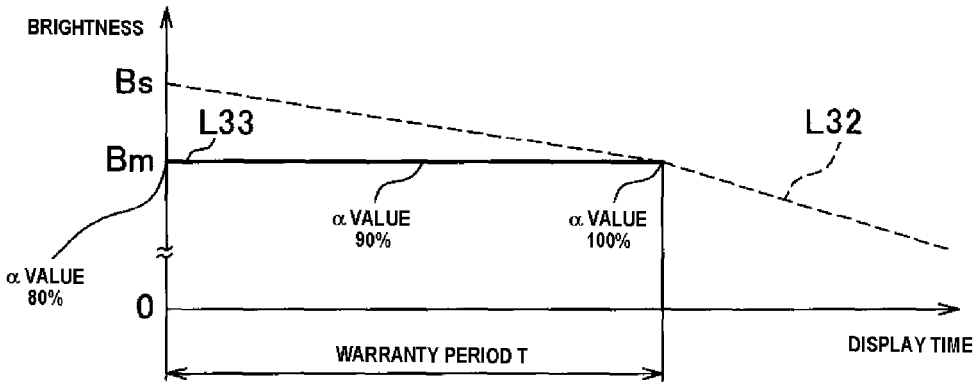
FIG. 24 is a graph showing the relationship between the brightness of a first display region on a display screen and a display time.

Specifically, as shown in FIG. 24, when each pixel in the first display region 315*b* of the indicator 315 has a brightness Bs at the start of use or at the time of replacement, the display device 301 for a vehicle displays the first display portion G311 of the first image information G31 on the indicator 315 with the initial gradation corresponding to the α value of 80%. Then, when the brightness Bs of the indicator 315 gradually deteriorates with a display time like a graph L32, the α value is made to change gradually from 80% to 100% so that the first display region 315*b* on the display screen 315*a* maintains the brightness Bm, and the α value is set to 100% when the display time equivalent to the warranty period T elapses. As a result, the display device 301 for a vehicle can display the first display region 315*b* with the brightness Bm during the warranty period T as shown in a graph L33.

Moreover, if the display device 301 for a vehicle measures the speed (measured amount) of the vehicle by sampling a speed signal at predetermined sampling intervals, the display device 301 for a vehicle displays the indicating portion G313 on the second display portion G312 in order to indicate a design pattern corresponding to the speed. That is, the display device 301 for a vehicle displays the indicating portion G313 by moving the tip of the indicating portion G313 on the second display portion G312 according to the measured amount so as to follow the design pattern. Thus, since the indicating portion G313 moves according to the measured amount, deterioration of pixel elements corresponding to the movement range of the indicating portion G313 in the second display portion G312 of the indicator 315 also occurs late.

Moreover, when a driver or the like requests display of the second image information G32 through an in-vehicle LAN in a state where non-uniformity of the brightness occurs in the first and second display regions 315*b* and 315*c* of the display screen 315*a*, the display device 301 for a vehicle displays the second image information G32 of the VRAM 316 and the transmissive image information, which corresponds to the newest α value described above, on the indicator 315 after alpha blending. As a result, since the indicator 315 adjusts the brightness of the entire screen corresponding to the first and second display portions G311 and G312, non-uniformity of the brightness caused by burn-in is unnoticeable in the second image information G32 displayed on the display screen 315*a*.

According to the display device 301 for a vehicle, the display screen 315*a* is displayed with the initial gradation which is lower than the gradation indicated by the first image information G31, the amount of brightness deterioration is estimated on the basis of the display time, and the first image information G31 is displayed on the display screen 315*a* according to the amount of brightness deterioration with the correction gradation obtained by correction from the initial gradation to the high gradation. As a result, since the brightness can be kept constant by increasing the gradation according to the amount of brightness deterioration of the self-luminous indicator 315, the display can be performed with the same brightness from the beginning of use even if the brightness of the self-luminous indicator 315 deteriorates with temporal change or the like. Therefore, it is possible to delay the deterioration by suppressing the gradation at the start of use of the self-luminous indicator 315 and to keep displaying the display screen 315*a* with a fixed brightness without complicating the device configuration. Moreover, since the device configuration is not complicated, an increase in device costs can be prevented. As a result, it can also contribute to low-priced vehicles and the like.

Moreover, according to the display device 301 for a vehicle, since exceeding the gradation set by the first image information G31 can be prevented during the warranty period T even if the gradation is corrected to a higher gradation than the initial gradation according to the amount of brightness deterioration of the self-luminous indicator 315, the display screen 315*a* can be reliably displayed with a fixed brightness continuously during the warranty period T.

Moreover, according to the display device 301 for a vehicle, since the gradation of each pixel is corrected by translucent combining of the transmissive image information and the first image information G31, the portion corresponding to the first display portion can be made to have the correction gradation by translucent combining of the first image information G31. For example, the gradation can be corrected by using a function of a graphics controller. Accordingly, it is possible to prevent the device from becoming complicated, and the cost can be reduced by using the existing functions effectively.

Moreover, if the display device 301 for a vehicle estimates the amount of brightness deterioration on the basis of the display time of the self-luminous indicator 315 and the temperature when using it, the amount of brightness deterioration of the self-luminous indicator can be estimated more precisely. Accordingly, the gradation can be reliably corrected to a correction gradation.

It is known that the life of the indicator 315 when used in a low-temperature condition, such as 25° C., is generally longer than that when used in a high-temperature condition, such as 80° C. Accordingly, the temperature of the indicator 315 is measured, and the life conversion information for estimating the life of the indicator 315 is created in advance from the temperature. In addition, the amount of brightness deterioration suitable for the indicator 315 is estimated from the life calculated on the basis of the measured temperature and the life conversion information.

For example, when measuring a display time, the display device 301 for a vehicle acquires the temperature detected by the temperature sensor 318 and calculates the life of the indicator 315 corresponding to the temperature from the life conversion information. Then, the display device 301 for a vehicle corrects the display time on the basis of the calculated life. Specifically, when it is expected that the calculated life may be shorter than the actual warranty period T of the indicator 315, the display device 315 for a vehicle performs correction for increasing the display time, estimates the amount of brightness deterioration of the indicator 315 from the corrected display time, and calculates an $\alpha$ value corresponding to the amount of brightness deterioration. Then, the display device 301 for a vehicle performs display control of the indicator 315 on the basis of the calculated a value.

For example, for a plurality of temperature ranges, such as 100 to 40° C., 40 to 0° C., and 0 to −40° C., the temperature adjustment information obtained by defining an adjustment coefficient for adjusting the $\alpha$ value in a table is stored in advance in the ROM 312 or the like. Then, when estimating the amount of brightness deterioration, the temperature of the indicator 315 is measured by the temperature sensor 318, and the $\alpha$ value is calculated by adjusting the $\alpha$ value corresponding to a display time using the adjustment coefficient of the temperature adjustment information. In addition, an embodiment may also be considered in which a corresponding display time is measured for every temperature range.

Thus, the display time of the indicator 315 is corrected to a display time suitable for the temperature and the amount of brightness deterioration is estimated on the basis of the corrected display time, the amount of brightness deterioration of the indicator 315 can be more precisely estimated. As a result, correction to the correction gradation suitable for the usage environment of the indicator 315 or the like becomes possible.

The above-described embodiments are only representative ones of the invention, and the invention is not limited to these embodiments. That is, various modifications and changes may be made within the scope and spirit of the invention.

The first to third embodiments described above may be executed not only independently but also by arbitrary combination thereof as long as their configurations do not conflict with each other.

What is claimed is:

1. A display device for a vehicle, comprising:

a self-luminous indicator which has a display screen with a plurality of pixels;

an image information storage unit for storing image information for setting the gradation of each of the plurality of pixels by which a given display pattern is displayed;

a display time measuring unit that is adapted to measure a display time of the self-luminous indicator that indicates an index to a deterioration of a part of the display screen;

a brightness deterioration amount estimating unit that is adapted to estimate an amount of brightness deterioration of each of the plurality of pixels on the basis of the display time measured by the display time measurement unit;

a first display control unit that displays the image information on the display screen to form the given display pattern with a brightness corresponding to an initial gradation which is lower than a gradation to be set for the image information; and a second display control unit that displays the image information on the display screen to form the given display pattern with a correction gradation, which is obtained by correction from the initial gradation to a higher gradation toward the gradation set for the image information, according to the amount of brightness deterioration estimated by the brightness deterioration amount estimating unit; wherein the brightness of each of the plurality of pixels is corrected based on a single display time for each of the plurality of pixels.

2. The display device according to claim 1, wherein the initial gradation is a gradation level which is lower than a gradation set by the image information within a warranty period of the display device.

3. The display device according to claim 1, further comprising:

a temperature measuring unit that measures the temperature of the self-luminous indicator, wherein the brightness deterioration amount estimating unit corrects the display time from the relationship between the temperature measured by the temperature measuring unit and the life of the self-luminous indicator and estimates the amount of brightness deterioration of the self-luminous indicator on the basis of the corrected display time.

4. The display device according to claim 1, wherein the image information has a first display portion fixedly displaying the given display pattern, and a second display portion which is formed in a different region from the first display portion and has lower brightness than the first display portion, and the second display control unit translucently combines the image information with transmissive image information in which a portion corresponding to the first display portion has certain transparency so as to have the correction gradation and displays the combined image on the self-luminous indicator.

5. A display device for a vehicle, comprising:

a self-luminous indicator which has a display screen with a plurality of pixels;

an image information storage unit for storing image information for setting the gradation of each of the plurality of pixels by which a given display pattern is displayed;

a display time measuring unit that is adapted to measure a display time of the self-luminous indicator that indicates an index to a deterioration of a part of the display screen;

a brightness deterioration amount estimating unit that is adapted to estimate an amount of brightness deterioration of each of the plurality of pixels on the basis of the display time measured by the display time measurement unit;

a first display control unit that displays the image information on the display screen to form the given display pattern with a brightness corresponding to an initial gradation which is lower than a gradation to be set for the image information; and a second display control unit that displays the image information on the display screen to form the given display pattern with a correction gradation, which is obtained by correction from the initial gradation to a higher gradation toward the gradation set for the image information, according to the amount of brightness deterioration estimated by the brightness deterioration amount estimating unit;

wherein the brightness of each of the plurality of pixels is corrected based on a single display time for each of the plurality of pixels, and wherein the given display pattern indicates that a predetermined area of the display screen illuminates with an approximately constant actual brightness on the self-luminous indicator.

6. The display device according to claim 5, wherein the initial gradation is a gradation level which is lower than a gradation set by the image information within a warranty period of the display device.

7. The display device according to claim 5, further comprising:

a temperature measuring unit that measures the temperature of the self-luminous indicator, wherein the brightness deterioration amount estimating unit corrects the display time from the relationship between the temperature measured by the temperature measuring unit and the life of the self-luminous indicator and estimates the amount of brightness deterioration of the self-luminous indicator on the basis of the corrected display time.

8. The display device according to claim 5, wherein the image information has a first display portion fixedly displaying the given display pattern, and a second display portion which is formed in a different region from the first display portion and has lower brightness than the first display portion, and the second display control unit translucently combines the image information with transmissive image information in which a portion corresponding to the first display portion has certain transparency so as to have the correction gradation and displays the combined image on the self-luminous indicator.

* * * * *